US008906586B2

(12) United States Patent
Mitsumori et al.

(10) Patent No.: US 8,906,586 B2
(45) Date of Patent: Dec. 9, 2014

(54) COATING FLUID FOR PHOTOSENSITIVE-LAYER FORMATION, PROCESS FOR PRODUCING THE SAME, PHOTORECEPTOR PRODUCED WITH THE COATING FLUID, IMAGE-FORMING APPARATUS EMPLOYING THE PHOTORECEPTOR, AND ELECTROPHOTOGRAPHIC CARTRIDGE EMPLOYING THE PHOTORECEPTOR

(75) Inventors: Teruyuki Mitsumori, Kanagawa (JP); Kozo Ishio, Kanagawa (JP); Hiroe Fuchigami, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 1202 days.

(21) Appl. No.: 12/301,361

(22) PCT Filed: May 18, 2007

(86) PCT No.: PCT/JP2007/060264

§ 371 (c)(1),
(2), (4) Date: Nov. 18, 2008

(87) PCT Pub. No.: WO2007/136007

PCT Pub. Date: Nov. 29, 2007

(65) Prior Publication Data

US 2009/0202274 A1 Aug. 13, 2009

(30) Foreign Application Priority Data

May 18, 2006 (JP) ..... 2006-138650

(51) Int. Cl.
*G03G 15/00* (2006.01)
*B01F 15/02* (2006.01)

(Continued)

(52) U.S. Cl.
CPC ..... *B01F 7/18* (2013.01); *B01F 15/026* (2013.01); *B01F 15/0201* (2013.01);

(Continued)

(58) Field of Classification Search
USPC ..... 430/96, 78, 59.6, 58.05, 57.1, 56
See application file for complete search history.

(56) References Cited

U.S. PATENT DOCUMENTS 4,158,572 A * 6/1979 Blackburn et al. ..... 106/412
5,391,448 A 2/1995 Katayama et al.

(Continued)

FOREIGN PATENT DOCUMENTS

EP 1 813 991 8/2007
JP 7-271078 10/1995

(Continued)

OTHER PUBLICATIONS

U.S. Appl. No. 12/301,121, filed Nov. 17, 2008, Mitsumori, et al.

(Continued)

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

A coating fluid for photosensitive-layer formation having high productivity and stability and a process thereof are provided. Also provided are a high-performance electrophotographic photoreceptor and an image-forming apparatus which are capable of forming high-quality images even in various use environments and are less apt to cause image defects such as black spots or color spots. The objects are accomplished with a process for producing a coating fluid which is for forming a photosensitive layer of an electrophotographic photoreceptor and comprises a charge-generating material and a binder resin, wherein a dispersing medium having an average particle diameter in the range of from 1.0 μm to 350 μm is used as a dispersing medium for dispersing the charge-generating material in the coating fluid for photosensitive-layer formation. The coating fluid for photosensitive-layer formation produced by this process is preferable as a photosensitive layer of an electrophotographic photoreceptor. The charge-generating material preferably comprises a phthalocyanine pigment and the phthalocyanine pigment in the coating fluid preferably has a 50% cumulative particle diameter (D50) of 0.13 μm or smaller as determined by a dynamic light scattering method.

16 Claims, 2 Drawing Sheets

(51) Int. Cl.

| | |
|---|---|
| ***B01F 15/06*** | (2006.01) |
| ***G03G 5/047*** | (2006.01) |
| ***B01F 3/12*** | (2006.01) |
| ***G03G 5/06*** | (2006.01) |
| ***B01F 7/18*** | (2006.01) |
| ***B02C 17/16*** | (2006.01) |
| ***G03G 5/05*** | (2006.01) |

(52) U.S. Cl.

CPC ..... *B01F 15/065* (2013.01); *G03G 5/047* (2013.01); *B01F 3/1221* (2013.01); *G03G 5/0696* (2013.01); *B02C 17/16* (2013.01); *G03G 5/0525* (2013.01)

USPC ..... 430/56; 430/96; 430/78; 430/59.6; 430/58.05; 430/57.1

(56) References Cited

U.S. PATENT DOCUMENTS

| | | | | |
|---|---|---|---|---|
| 5,776,650 | A | 7/1998 | Hashimoto et al. | |
| 5,882,246 | A | 3/1999 | Inkyo et al. | |
| 6,197,463 | B1 * | 3/2001 | Cais et al. | 430/58.05 |
| 2006/0088778 | A1 | 4/2006 | Itami et al. | |
| 2007/0003851 | A1 * | 1/2007 | Kawahara et al. | 430/59.2 |
| 2007/0231721 | A1 * | 10/2007 | Nukada et al. | 430/66 |

FOREIGN PATENT DOCUMENTS

| | | |
|---|---|---|
| JP | 8 272111 | 10/1996 |
| JP | 10 7925 | 1/1998 |
| JP | 10-69116 | 3/1998 |
| JP | 10-260545 | 9/1998 |
| JP | 2000-242016 | 9/2000 |
| JP | 2000-258939 | 9/2000 |
| JP | 2001 290292 | 10/2001 |
| JP | 2002 80432 | 3/2002 |
| JP | 2004 78140 | 3/2004 |
| JP | 2004 233678 | 8/2004 |
| JP | 2004-246300 | 9/2004 |
| JP | 2004 246300 | 9/2004 |
| JP | 2005-181467 | 7/2005 |
| JP | 2005-338445 | 12/2005 |
| JP | 2006-72304 | 3/2006 |
| JP | 2006 72304 | 3/2006 |
| JP | 2006 131897 | 5/2006 |

OTHER PUBLICATIONS

U.S. Appl. No. 12/300,943, filed Nov. 14, 2008, Mitsumori, et al.
U.S. Appl. No. 12/301,088, filed Nov. 17, 2008, Mitsumori, et al.
U.S. Appl. No. 12/301,109, filed Nov. 17, 2008, Mitsumori, et al.
U.S. Appl. No. 13/188,743, filed Jul. 22, 2011, Fuchigami.
U.S. Appl. No. 12/612,982, filed Nov. 5, 2009, Fuchigami.
U.S. Appl. No. 12/613,023, filed Nov. 5, 2009, Fuchigami.
U.S. Appl. No. 12/301,376, filed Nov. 18, 2008, Mitsumori, et al.
U.S. Appl. No. 12/300,853, filed Nov. 14, 2008, Fuchigami, et al.
Office Action issued Dec. 13, 2011, in Japanese Patent Application No. 2007-132222 (with English-language translation).
Office Action as received in the corresponding Japanese Patent No. 2007-132222 dated Aug. 21, 2012 w/English Translation.

* cited by examiner

COATING FLUID FOR PHOTOSENSITIVE-LAYER FORMATION, PROCESS FOR PRODUCING THE SAME, PHOTORECEPTOR PRODUCED WITH THE COATING FLUID, IMAGE-FORMING APPARATUS EMPLOYING THE PHOTORECEPTOR, AND ELECTROPHOTOGRAPHIC CARTRIDGE EMPLOYING THE PHOTORECEPTOR

TECHNICAL FIELD

The present invention relates to a coating fluid for photosensitive-layer formation which is for use in forming a photosensitive layer of an electrophotographic photoreceptor through coating and drying, a process for producing the coating fluid, a photoreceptor produced using the coating fluid, an image-forming apparatus employing the photoreceptor, and an electrophotographic cartridge employing the photoreceptor. The electrophotographic photoreceptor having a photosensitive layer formed by applying and drying the coating fluid for photosensitive-layer formation of the invention can be advantageously used in electrophotographic printers, facsimile telegraphs, copiers, etc.

BACKGROUND ART

Electrophotography is extensively used and applied in recent years not only in the field of copiers but in the field of various printers because of its instantaneousness, ability to give high-quality images, etc. With respect to photoreceptors serving as the core of electrophotography, organic photoreceptors have been developed which employ an organic photoconductive material having advantages over inorganic photoconductive materials, such as pollution-free nature and ease of production. Although an organic photoreceptor generally comprises a conductive support and a photosensitive layer formed thereon, known examples thereof include photoreceptors of the so-called single-layer type which have a single-layer photosensitive layer comprising a binder resin and a photoconductive material dissolved or dispersed therein and photoreceptors of the so-called lamination type which have a photosensitive layer composed of superposed layers comprising a charge-generating layer containing a charge-generating material and a charge-transporting layer containing a charge-transporting material.

The layer possessed by an organic photoreceptor is generally formed by applying and drying a coating fluid prepared by dissolving or dispersing materials in any of various solvents because this method has high productivity. However, in the case of the charge-generating layer comprising a charge-generating material and a binder resin, the charge-generating material and the binder resin in the charge-generating layer are present in the state of being incompatible with each other. Because of this, the charge-generating layer formation coating fluid is formed by applying a coating fluid containing the charge-generating material dispersed therein.

Hitherto, such a coating fluid has been produced by subjecting a charge-generating material to a long-term wet dispersing treatment in an organic solvent with a known mechanical pulverizer such as a ball mill, sand grinding mill, planetary mill, or roll mill (see, for example, patent document 1).

It has been proposed that in the case of dispersing the charge-generating material in a coating fluid for charge-generating-layer formation with a dispersing medium, use of a glass or zirconia as the material of the dispersing medium enables an electrophotographic photoreceptor having excellent electrical properties to be provided (see, for example, patent document 2).

Patent Document 1: JP-A-2001-290292

Patent Document 2: JP-A-2004-78140

DISCLOSURE OF THE INVENTION

Problems that the Invention is to Solve

However, under the current situation in which the formation of higher-quality images is required, the photoreceptors obtained by such related-art electrophotographic techniques have still had various insufficient points concerning performances such as, e.g., image quality and coating fluid stability in production. With respect to productivity also, the techniques have not always been satisfactory production processes.

The invention has been achieved in view of the electrophotographic techniques described above. An object of the invention is to provide a coating fluid for photosensitive-layer formation having high productivity and stability and a process for producing the coating fluid. Another object is to provide a high-performance electrophotographic photoreceptor which can form high-quality images even in various use environments and is less apt to cause image defects such as black spots and color spots. Still another object is to provide an image-forming apparatus employing the photoreceptor and an electrophotographic cartridge employing the photoreceptor.

Means for Solving the Problems

The present inventors made intensive investigations on the problems described above. As a result, they have found that when a coating fluid for photosensitive-layer formation containing a charge-generating material is regulated so that the particle size of the charge-generating material is in a specific range, then a coating fluid for forming a high-performance photosensitive layer is obtained. They have further found a process for coating fluid production in which a coating fluid for photosensitive-layer formation having excellent stability during use can be obtained with high productivity when a dispersing medium having an especially smaller particle diameter as compared with the particle diameters of dispersing media in common use is employed for a dispersing treatment in the particle size regulation (the charge-generating material contained in this coating fluid also has a smaller particle diameter than known ones). The inventors have furthermore found that an electrophotographic photoreceptor having a photosensitive layer obtained by applying and drying this coating fluid has satisfactory electrical properties even in different use environments, and that an image-forming apparatus and an electrophotographic photoreceptor cartridge each employing this photoreceptor can form images of high quality and are exceedingly less apt to cause image defects, such as black spots or color spots, which are thought to generate due to dielectric breakdown, etc. The invention has been thus achieved.

Essential points of the invention are as follows.

(1) A process for producing a coating fluid which is for forming a photosensitive layer of an electrophotographic photoreceptor and comprises a charge-generating material and a binder resin, wherein a dispersing medium having an average particle diameter in the range of from 1.0 μm to 350 μm is used as a dispersing medium for dispersing the charge-generating material in the coating fluid for photosensitive-layer formation.

(2) The process for producing a coating fluid for photosensitive-layer formation as described under (1) above, wherein the dispersing medium comprises zirconia beads.

(3) The process for producing a coating fluid for photosensitive-layer formation as described under (1) or (2) above, wherein the dispersion of the charge-generating material with the dispersing medium is conducted by means of a ball mill.

(4) The process for producing a coating fluid for photosensitive-layer formation as described under any one of (1) to (3) above, wherein the ball mill is a wet type stirring ball mill comprising: a cylindrical stator; a slurry feed opening formed in one end of the stator; a slurry discharge opening formed in another end of the stator; a rotor for stirring/mixing the dispersing medium to be packed in the stator and a slurry which is to be fed through the slurry feed opening and contains the charge-generating material and the binder resin; and a separator connected to the slurry discharge opening and capable of separating the slurry from the dispersing medium by an action of centrifugal force and discharging the separated slurry through the slurry discharge opening, and the separator is rotated/driven with a shaft, and the axial center of the shaft has a hollow discharge passage connected to the slurry discharge opening.

(5) The process for producing a coating fluid for photosensitive-layer formation as described under any one of (1) to (3) above, wherein the ball mill is a wet type stirring ball mill comprising: a cylindrical stator; a slurry feed opening formed in one end of the stator; a slurry discharge opening formed in another end of the stator; a rotor for stirring/mixing the dispersing medium to be packed in the stator and a slurry which is to be fed through the slurry feed opening and contains the charge-generating material and the binder resin; and a separator connected to the slurry discharge opening and capable of separating the slurry from the dispersing medium by the action of centrifugal force and discharging the separated slurry through the slurry discharge opening, and the separator comprises: two disks each of which has a blade-fitting groove on the opposed inner sides thereof; a blade interposed between the disks and fitted in the fitting grooves; and a supporting means which holds from both sides the disks having the blades interposed therebetween.

(6) A coating fluid for photosensitive-layer formation, which is produced by the process for producing a coating fluid for photosensitive-layer formation as described under any one of (1) to (5) above.

(7) A coating fluid for photosensitive-layer formation which is a coating fluid for forming a photosensitive layer of an electrophotographic photoreceptor and contains a charge-generating material and a binder resin, wherein the charge-generating material is a phthalocyanine pigment and the phthalocyanine pigment in the coating fluid has a 50% cumulative particle diameter (D50) of 0.13 μm or smaller as determined by a dynamic light scattering method.

(8) The coating fluid for photosensitive-layer formation as described under (7) above, wherein the phthalocyanine pigment has a volume-average particle diameter of 0.05 μm or smaller and a 90% cumulative particle diameter (D90) of 0.25 μm or smaller.

(9) An electrophotographic photoreceptor comprising a photosensitive layer formed from the coating fluid for photosensitive-layer formation as described under any one of (6) to (8) above.

(10) The electrophotographic photoreceptor as described under (9) above, wherein the photosensitive layer is a single-layer type photosensitive layer formed from a coating fluid obtained by further incorporating a charge-transporting material into the coating fluid for photosensitive-layer formation containing a charge-generating material.

(11) The electrophotographic photoreceptor as described under (9) above, wherein the photosensitive layer is a lamination type photosensitive layer where a charge-generating layer formed from the coating fluid for photosensitive-layer formation containing a charge-generating material and a charge-transporting layer formed from a coating fluid containing a charge-transporting material, are laminated.

(12) An image-forming apparatus comprising: the electrophotographic photoreceptor as described under any one of (9) to (11) above; a charging device which charges the electrophotographic photoreceptor; an imagewise-exposure device which imagewise exposes the charged electrophotographic photoreceptor to a light to form an electrostatic latent image; a development device which develops the electrostatic latent image with a toner; and a transfer device which transfers the toner to a object to be transferred.

(13) The image-forming apparatus as described under (12) above, wherein the charging device is in contact with the electrophotographic photoreceptor at least when the electrophotographic photoreceptor is charged or when the latent image formed on the electrophotographic photoreceptor is developed.

(14) The image-forming apparatus as described under (12) or (13) above, wherein the light employed in the imagewise-exposure device has a wavelength in the range of from 350 nm to 600 nm.

(15) An electrophotographic photoreceptor cartridge comprising: the electrophotographic photoreceptor as described under any one of (9) to (11) above; and at least one of a charging device which charges the electrophotographic photoreceptor, an exposure device which imagewise exposes the charged electrophotographic photoreceptor to a light to form an electrostatic latent image, a development device which develops the electrostatic latent image formed on the electrophotographic photoreceptor, a transfer device which transfers the toner to a object to be transferred, and a cleaning device which recovers the toner adherent to the electrophotographic photoreceptor.

(16) The electrophotographic cartridge as described under (15) above, wherein the charging device is in contact with the electrophotographic photoreceptor at least when the electrophotographic photoreceptor is charged or when the latent image formed on the electrophotographic photoreceptor is developed.

ADVANTAGES OF THE INVENTION

According to the process of the invention for producing a coating fluid for photosensitive-layer formation, production with high productivity is possible. The coating fluid for photosensitive-layer formation of the invention produced is in a stable state, suffers neither gelation nor precipitation of the dispersed charge-generating material, and can be stored and used over long. This coating fluid changes little in properties including viscosity during use. Because of this, when the coating fluid is continuously applied to supports and dried to form photosensitive layers, the photosensitive layers produced have an even thickness.

Furthermore, the electrophotographic photoreceptor of the invention has stable electrical properties even at low temperatures and low humidities and has excellent electrical properties. The image-forming apparatus employing the electrophotographic photoreceptor of the invention can form satisfactory images extremely reduced in image defects such as black spots and color spots. In particular, the image-forming apparatus in which the electrophotographic photoreceptor is charged with a charging device disposed in contact with the photoreceptor can form satisfactory images extremely reduced in image defects such as black spots and color spots. Moreover, the image-forming apparatus which employs the electrophotographic photoreceptor of the invention and an imagewise exposure device employing a light having a wavelength in the range of from 350 nm to 600 nm has a high initial acceptance potential and high sensitivity and, hence, can give high-quality images.

DESCRIPTION OF THE REFERENCE NUMERALS AND SIGNS

Figure 1:
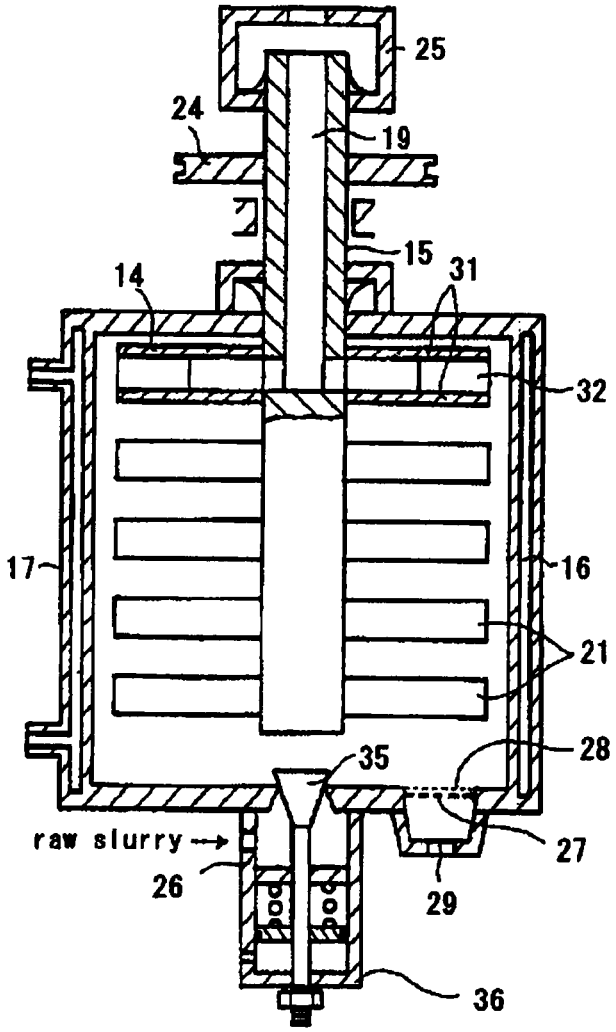
FIG. 1 is a vertical sectional view of a wet type stirring ball mill relating to the invention.

1 photoreceptor
2 charging device (charging roller)
3 exposure device
4 development device
5 transfer device
6 cleaning device
7 fixing device
41 developing vessel
42 agitator
43 feed roller
44 developing roller
45 control member
71 upper fixing member (pressure roller)
72 lower fixing member (fixing roller)
73 heater
T toner
P receiving material (paper or medium)
14 separator
15 shaft
16 jacket
17 stator
19 discharge passage
21 rotor
24 pulley
25 rotary joint
26 feed opening for raw slurry
27 screen support
28 screen
29 product slurry takeout opening
31 disk
32 blade
35 valve plug

BEST MODE FOR CARRYING OUT THE INVENTION

The invention will be explained below in detail by reference to embodiments thereof. However, the following explanations on constituent elements are for typical embodiments of the invention, and the constituent elements can be suitably modified as long as the modifications do not depart from the spirit of the invention.

[Coating Fluid for Photosensitive-Layer Formation and Process for Producing the Same]

The process of the invention for producing a coating fluid for photosensitive-layer formation is a process for producing a coating fluid for photosensitive-layer formation containing a charge-generating material and a binder resin. In this production, a dispersing medium having an average particle diameter in the range of from 1.0 μm to 350 μm is used as a dispersing medium for dispersing the charge-generating material in the coating fluid for photosensitive-layer formation. The coating fluid for photosensitive-layer formation produced is a coating fluid which contains the charge-generating material and binder resin dispersed therein and form which the dispersing medium has been removed. This coating fluid may be used as a "coating fluid for photosensitive-layer formation" which is used for forming a single-layer type photosensitive layer containing a charge-generating material and a charge-transporting material or as a "coating fluid for charge-generating-layer formation" which is used for forming a lamination type photosensitive layer composed of superposed layers comprising a charge-generating layer and a charge-transporting layer.

<Charge-Generating Material>

The charge-generating material is a constituent ingredient for the coating fluid for photosensitive-layer formation, and various charge-generating materials which have been proposed for use in photosensitive layers in electrophotographic photoreceptors can be used. Examples of the charge-generating material include azo pigments, phthalocyanine pigments, anthanthrone pigments, quinacridone pigments, cyanine pigments, pyrylium pigments, thiapyrylium pigments, indigo pigments, polycyclic quinone pigments, and squearic acid pigments. Especially preferred are phthalocyanine pigments or azo pigments. Phthalocyanine pigments are superior because of their ability to form an electrophotographic photoreceptor highly sensitive to a laser light having a relatively long wavelength, while azo pigments are superior because of their ability to form an electrophotographic photoreceptor sufficiently sensitive to white light and a laser light having a relatively short wavelength.

Use of a phthalocyanine pigment as the charge-generating material is preferred because it produces the excellent effect described above. Examples of the phthalocyanine pigment include metal-free phthalocyanines and phthalocyanine pigments in various crystal forms to which a metal, e.g., copper, indium, gallium, tin, titanium, zinc, vanadium, silicon, or germanium, or an oxide, halide, hydroxide, alkoxide, or another form of the metal has coordinated. Especially preferred are X-form and τ-form metal-free phthalocyanines, which are crystal forms having high sensitivity, A-form (also called β-form), B-form (also called α-form), D-form (also called Y-form), and other oxytitanium phthalocyanines, oxyvanadium phthalocyanines, chloroindium phthalocyanines, II-form and other chlorogallium phthalocyanines, V-form and other hydroxygallium phthalocyanines, G-form, I-form, and other μ-oxogallium phthalocyanine dimers, and II-form and other μ-oxoaluminum phthalocyanine dimers. Especially preferred of these phthalocyanine pigments are A-form (β-form), B-form (α-form), and D-form (Y-form) oxytitanium phthalocyanines, II-form chlorogallium phthalocyanine, V-form hydroxygallium phthalocyanine, G-form μ-oxogallium phthalocyanine dimer, and the like. Preferred of these phthalocyanine pigments are the following phthalocyanines which, when examined with $CuK_{\alpha}$ characteristic X-ray, each give an X-ray diffraction spectrum showing the following main diffraction peak(s) at the following Bragg angle(s) (2θ±0.2°): oxytitanium phthalocyanine showing a main diffraction peak at 27.3°; oxytitanium phthalocyanine showing main diffraction peaks at 9.3°, 13.2°, 26.2°, and 27.1°; dihydroxysilicon phthalocyanine having main diffraction peaks at 9.2°, 14.1°, 15.3°, 19.7°, and 27.1°; dichlorotin phthalocyanine showing main diffraction peaks at 8.5°, 12.2°, 13.8°, 16.9°, 22.4°, 28.4°, and 30.1°; hydroxygallium phthalocyanine showing main diffraction peaks at 7.5°, 9.9°, 12.5°, 16.3°, 18.6°, 25.1°, and 28.3°; and chlorogallium phthalocyanine showing diffraction peaks at 7.4°, 16.6°, 25.5°, and 28.3°. Especially preferred of these is oxytitanium phthalocyanine showing a main diffraction peak at 27.3°. In this case, it is particularly preferred to use oxytitanium phthalocyanine showing main diffraction peaks at 9.5°, 24.1°, and 27.3°.

The phthalocyanine pigment to be used may consist of a single compound only, or some phthalocyanine compounds in a mixture or mixed-crystal state may be used. The mixture state or mixed-crystal state of phthalocyanine pigments may be one formed by mixing the phthalocyanine pigments later or may be one formed in the phthalocyanine compound production steps or treatment steps including synthesis, pigment preparation, and crystallization. Known treatments for forming the mixture state or mixed-crystal state include an acid paste treatment, grinding treatment, and solvent treatment. Examples of methods for forming the mixed-crystal state include a technique which comprises mixing two kinds of crystals, subsequently mechanically grinding the mixture to bring it into an amorphous state, and then subjecting it to a solvent treatment to convert the amorphous state into a specific crystalline state, as described in JP-A-10-48859.

In the case where a phthalocyanine pigment is used as a charge-generating material, another charge-generating material may be used in combination with the phthalocyanine pigment. For example, an azo pigment, perylene pigment, quinacridone pigment, polycyclic quinone pigment, indigo pigment, benzimidazole pigment, pyrylium salt, thiapyrylium salt, squarylium salt, or the like can be used in combination with the phthalocyanine pigment.

In the case where a combination with an azo pigment is used, any of various known bisazo pigments and trisazo pigments is suitable. Examples of such preferred azo pigments are shown below. In the following general formulae, $Cp^1$ to $Cp^3$ each represent a coupler.

[Ka-1]

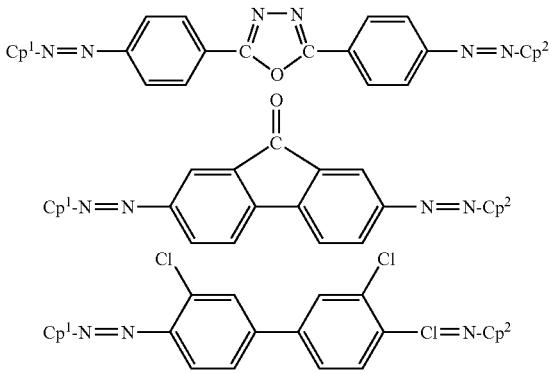

-continued

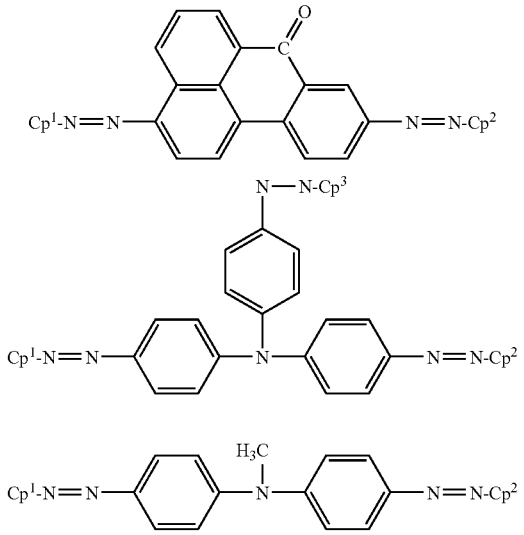

The couplers $Cp^1$ to $Cp^3$ preferably represent the following structures. In the following structures, "※" indicates the position of bonding.

[Ka-2]

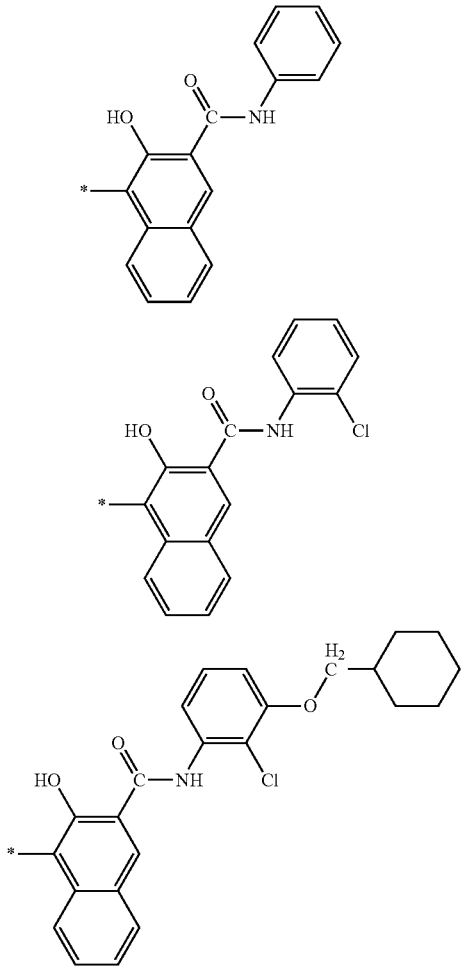

-continued
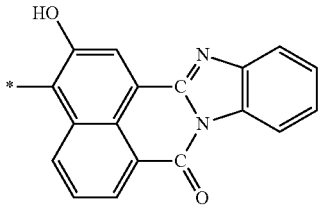
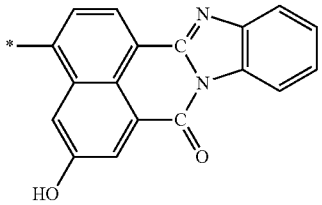
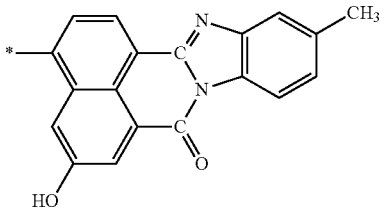
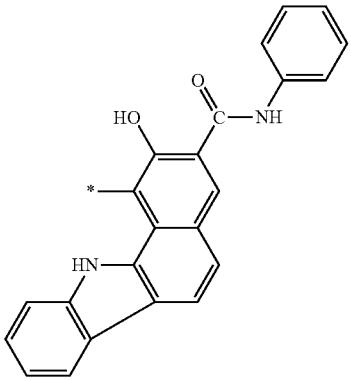
-continued
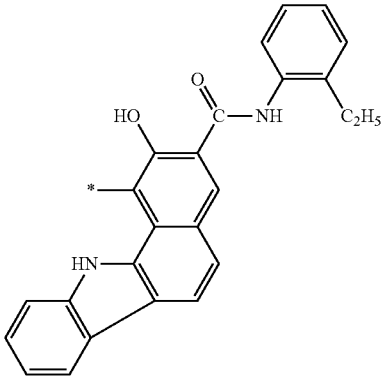
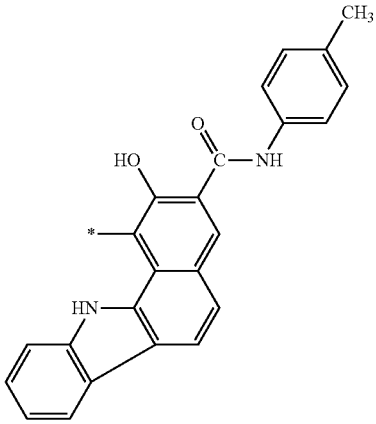
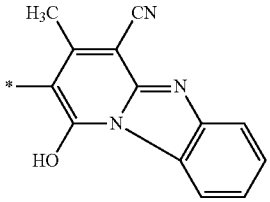
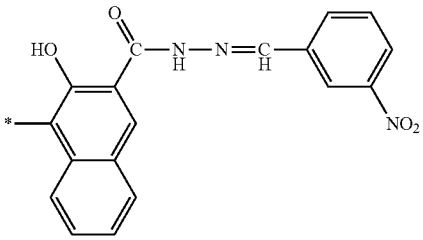
Especially preferred examples of the azo compounds are shown below.
[Ka-3]
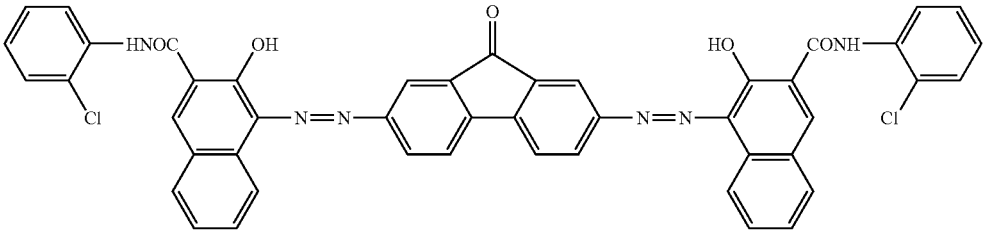

-continued
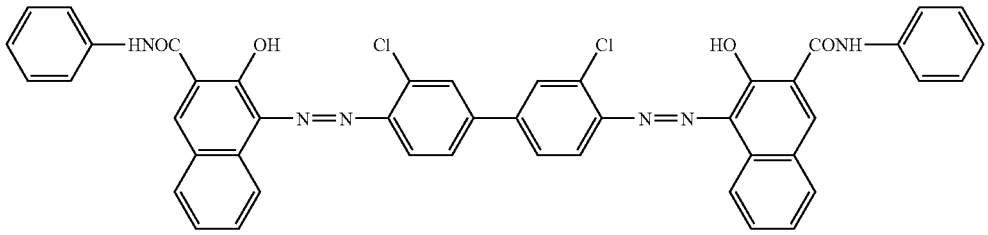
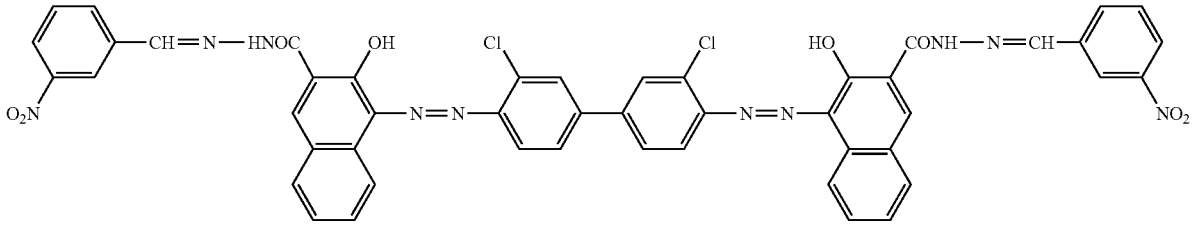
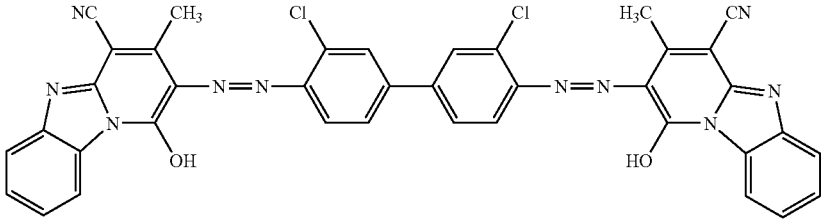
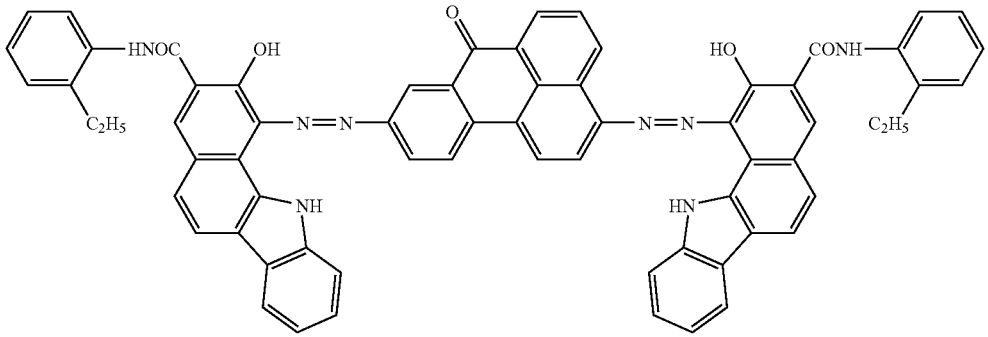
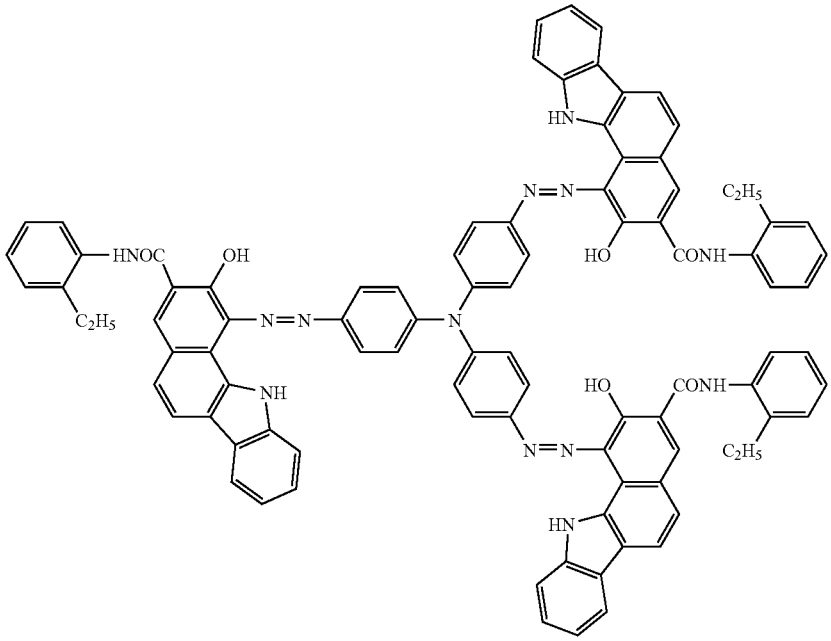

-continued
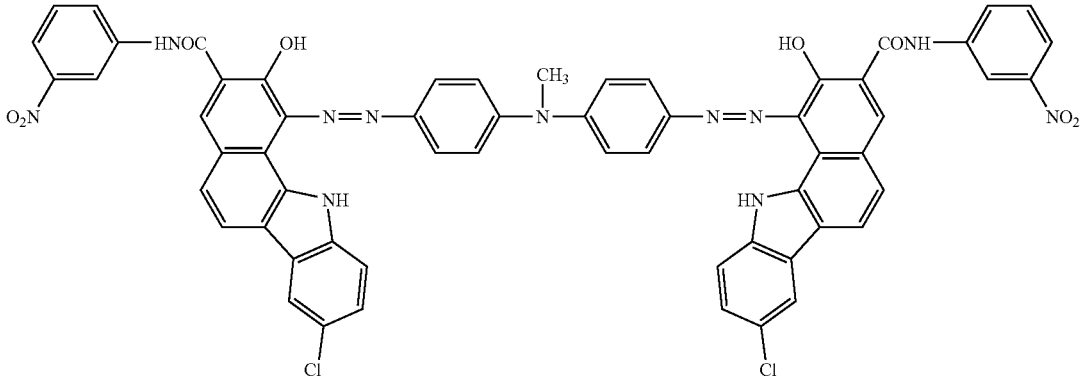
[Ka-4]
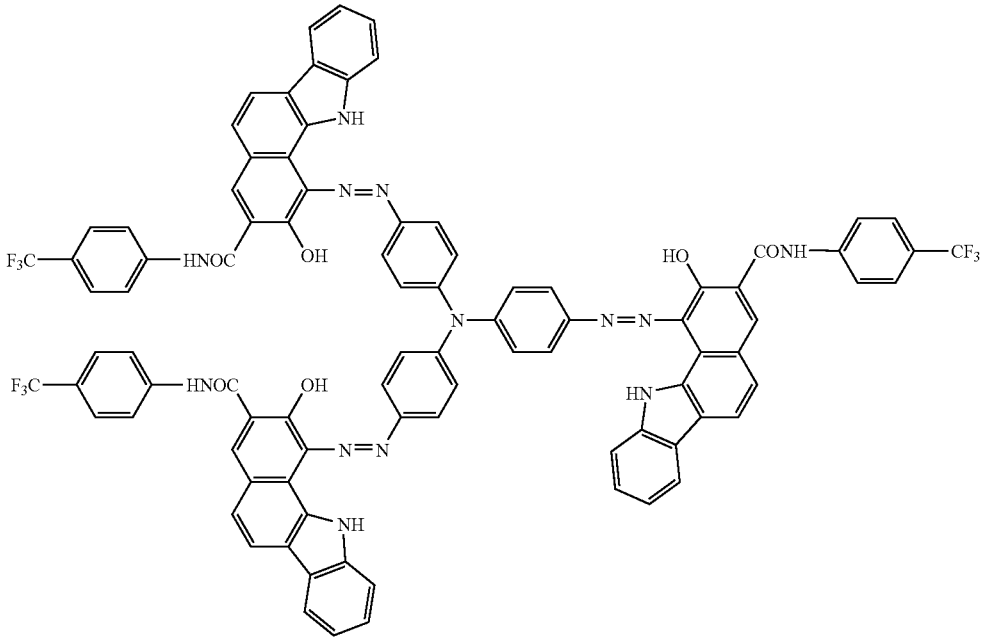
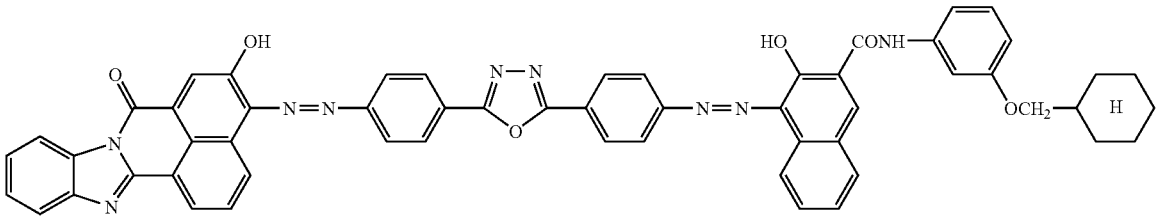
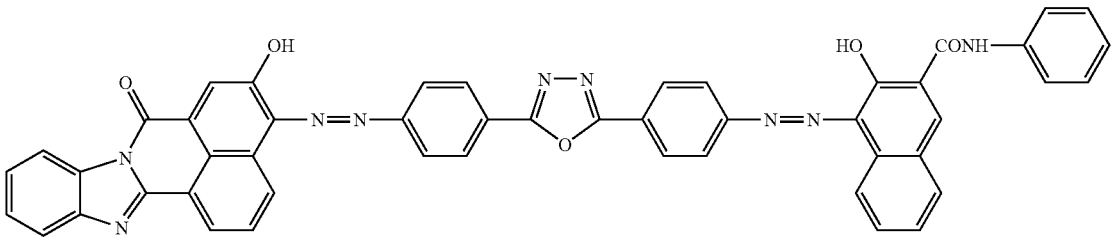

-continued

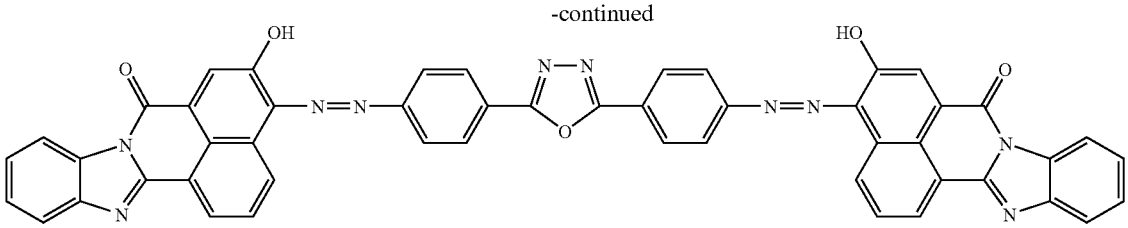

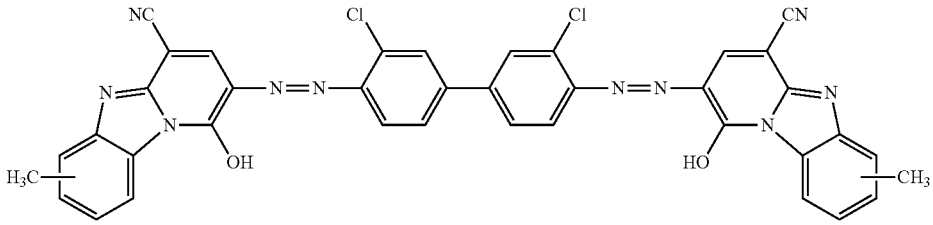

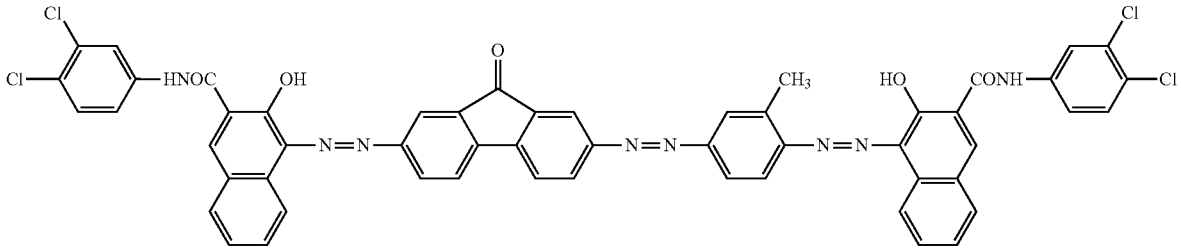

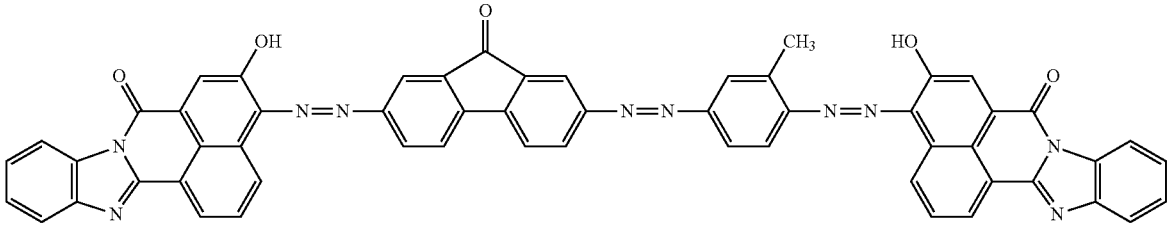

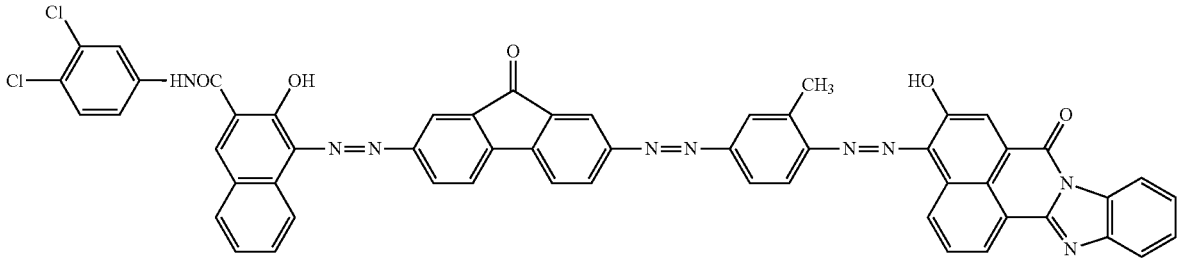

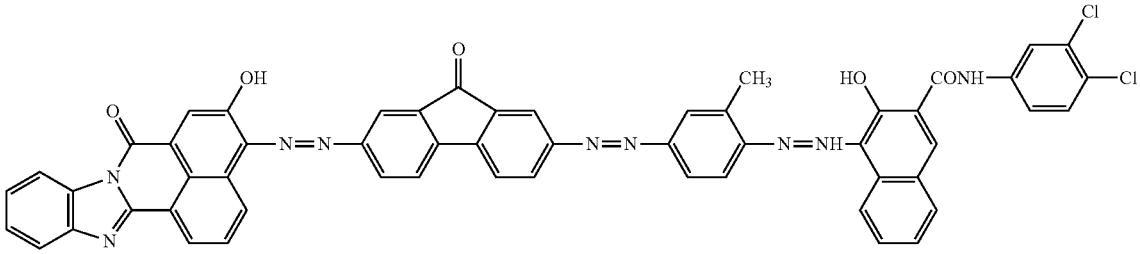

Although the charge-generating material is dispersed in the coating fluid for photosensitive-layer formation, it may have undergone pre-pulverization before being dispersed in the coating fluid. The pre-pulverization can be conducted with various pulverizers. In general, however, it is conducted with a pulverizer such as a ball mill or a sand grinding mill. As the pulverizing medium to be introduced into these pulverizers, any pulverizing medium can be used as long as it is not powdered during the pulverization treatment and can be easily separated after the dispersing treatment. However, preferred examples thereof include beads or balls of a glass, alumina, zirconia, stainless steel, or ceramic. The pre-pulverization may be conducted to a volume-average particle diameter of preferably 500 μm or smaller, more preferably 250 μm or smaller. The volume-average particle diameter may be determined by any method commonly used by persons skilled in the art. However, it is generally determined by the precipitation method or centrifugal precipitation method.

<Binder Resin>

As the binder resin may be used an organic-solvent-soluble binder resin such as those in common use in coating fluids for forming the photosensitive layers of electrophotographic photoreceptors. In the case where the coating fluid for photosensitive-layer formation is a coating fluid for forming the charge-generating layer of a lamination type photosensitive layer and another layer is to be formed on the charge-generating layer formed, then the binder resin to be used may be any resin without particular limitations as long as it is insoluble in the organic solvent contained in the coating fluid for forming the "another layer" or is poorly soluble in that solvent and substantially immiscible therewith.

Examples of the binder resin include poly(vinyl butyral) resins, poly(vinyl formal) resins, poly(vinyl acetal) resins such as partially acetalized poly(vinyl butyral) resins in which the butyral moieties have been partly modified with formal or acetal, polyarylate resins, polycarbonate resins, polyester resins, ether-modified polyester resins, phenoxy resins, poly(vinyl chloride) resins, poly(vinylidene chloride) resins, poly(vinyl acetate) resins, polystyrene resins, acrylic resins, methacrylic resins, polyacrylamide resins, polyamide resins, polyvinylpyridine resins, cellulosic resins, polyurethane resins, epoxy resins, silicone resins, poly(vinyl alcohol) resins, polyvinylpyrrolidone resins, and casein. Examples thereof further include insulating resins such as vinyl chloride/vinyl acetate-based copolymers, e.g., vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicone-alkyd resins, and phenol/formaldehyde resins; and organic photoconductive polymers such as poly(N-vinylcarbazole), polyvinylanthracene, and polyvinylperylene. Although a binder resin selected from these can be used, the resin to be used should not be construed as being limited to these polymers. These binder resins may be used alone or as a mixture of two or more thereof.

Examples of the solvent or dispersion medium to be used in dissolving the binder resin therein for producing the coating fluid include saturated aliphatic solvents such as pentane, hexane, octane, and nonane, aromatic solvents such as toluene, xylene, and anisole, halogenated aromatic solvents such as chlorobenzene, dichlorobenzene, and chloronaphthalene, amide solvents such as dimethylformamide and N-methyl-2-pyrrolidone, alcohol solvents such as methanol, ethanol, isopropanol, n-butanol, and benzyl alcohol, aliphatic polyhydric alcohols such as glycerol and polyethylene glycol, chain, branched, and cyclic ketone solvents such as acetone, cyclohexanone, methyl ethyl ketone, and 4-methoxy-4-methyl-2-pentanone, ester solvents such as methyl formate, ethyl acetate, and n-butyl acetate, halogenated hydrocarbon solvents such as methylene chloride, chloroform, and 1,2-dichloroethane, chain and cyclic ether solvents such as diethyl ether, dimethoxyethane, tetrahydrofuran, 1,4-dioxane, methyl Cellosolve, and ethyl Cellosolve, aprotic polar solvents such as acetonitrile, dimethyl sulfoxide, sulfolane, and hexamethylphosphoric triamide, nitrogen-containing compounds such as n-butylamine, isopropanolamine, diethylamine, triethanolamine, ethylenediamine, triethylenediamine, and triethylamine, mineral oils such as ligroin, and water. Especially preferred is one in which the undercoat layer which will be described later does not dissolve. Those solvents or dispersion media may be used alone or in combination of two or more thereof.

In the case where the charge-generating layer of a function allocation type photosensitive layer in which separate layers respectively containing a charge-generating material and a charge-transporting material are superposed (so-called lamination type photosensitive layer) is to be formed from a coating fluid, the binder resin and the charge-generating material as constituent ingredients for the coating fluid may be incorporated in such a ratio (by weight) that the amount of the charge-generating material is in the range from 10 parts by weight to 1,000 parts by weight, preferably from 30 parts by weight to 500 parts by weight, per 100 parts by weight of the binder resin. The thickness of this charge-generating layer is generally from 0.1 μm to 4 μm, preferably from 0.15 μm to 0.6 μm. When the proportion of the charge-generating material is too high, there are cases where the coating fluid has reduced stability due to problems such as the aggregation of the charge-generating material. On the other hand, in case where the proportion of the charge-generating material is too low, this leads to a decrease in the sensitivity of the resultant photoreceptor. It is therefore preferred to use the charge-generating material in an amount with that range.

On the other hand, in the case where a single-layer type photosensitive layer which has a charge-generating material and a charge-transporting material in the same layer is to be formed from a coating fluid, the binder resin and charge-generating material, among the binder resin, charge-generating material, and charge-transporting material as constituent ingredients for the coating fluid, may be incorporated in such a ratio (by weight) that the amount of the charge-generating material is in the range of from 0.2 parts by weight to 100 parts by weight, preferably from 0.5 parts by weight to 20 parts by weight, per 100 parts by weight of the binder resin. The thickness of this photosensitive layer is generally from 1 μm to 40 μm, preferably from 5 μm to 30 μm. When the proportion of the charge-generating material is too high, there are cases where the coating fluid has reduced stability due to problems such as the aggregation of the charge-generating material. On the other hand, in case where the proportion of the charge-generating material is too low, this leads to a decrease in the sensitivity of the resultant photoreceptor. It is therefore preferred to use the charge-generating material in an amount with that range.

Examples of the charge-transporting material to be used in the case where a single-layer type photosensitive layer having a charge-generating material and a charge-transporting material in the same layer is formed from a coating fluid include polymeric compounds such as polyvinylcarbazole, polyvinylpyrene, polyglycidylcarbazole, and polyacenaphthylene; polycyclic aromatic compounds such as pyrene and anthracene; heterocyclic compounds such as indole derivatives, imidazole derivatives, carbazole derivatives, pyrazole derivatives, pyrazoline derivatives, oxadiazole derivatives, oxazole derivatives, and thiazole derivatives; hydrazone compounds such as p-diethylaminobenzaldehyde N,N-diphenylhydrazone and N-methylcarbazole-3-carbaldehyde N,N-diphenylhydrazone; styryl compounds such as 5-(4-(di-p-tolylamino)benzylidene)-5H-dibenzo(a,d)cyclohept ene;

triarylamine compounds such as p-tritolylamine; benzidine compounds such as N,N,N',N'-tetraphenylbenzidine; butadiene compounds; and triphenylmethane compounds such as di(p-ditolylaminophenyl)methane. Preferred of these are hydrazone derivatives, carbazole derivatives, styryl compounds, butadiene compounds, triarylamine compounds, benzidine compounds, or compounds each made up of two or more of these compounds bonded to each other. Those charge-transporting materials may be used alone or as a mixture of some of these.

<Dispersing Medium>

As the dispersing medium, various kinds of dispersing media can be used. However, it is preferred to use a dispersing medium having a nearly spherical shape. The average particle diameter of a dispersing medium can be determined by a method in which the medium is sieved with, e.g., the sieves described in JIS Z 8801:2000 or by image analysis, and the density thereof can be determined by the Archimedes method. Specifically, the average particle diameter and sphericity can be determined with an image analyzer represented by, e.g., LUZEX 50, manufactured by Nireco Corp.

The average particle diameter of the dispersing medium to be used is generally in the range of from 1.0 μm to 350 μm, especially more preferably in the range of from 10 μm to 100 μm. Dispersing media having smaller particle diameters generally tend to give an even dispersion in a shorter time period. However, when a dispersing medium having an excessively small particle diameter is used, there are cases where an efficient dispersing treatment is impossible because of the too small mass of each dispersing-medium particle.

The density of the dispersing medium to be used is generally 5.5 g/cm$^3$ or higher, preferably 5.9 g/cm$^3$ or higher, more preferably 6.0 g/cm$^3$ or higher. In general, use of dispersing media having a higher density in a dispersion process tends to give an even dispersion in a shorter time period. The upper limit of the density varies depending on the material of the dispersion medium and, hence, cannot be unconditionally specified. However, it is generally about 10 g/m$^3$ when usable materials are taken into account. The density of a dispersing medium can be measured, for example, by the liquid immersion method or the gas volume method.

The sphericity of the dispersing medium is preferably 1.08 or lower, more preferably 1.07 or lower.

With respect to the material of the dispersing medium, any known dispersing medium can be used as long as it is insoluble in the coating fluid for photosensitive-layer formation, has a higher specific gravity than the coating fluid for photosensitive-layer formation, and neither reacts with nor alters the coating fluid for photosensitive-layer formation. Examples thereof include steel spheres such as chrome spheres (steel spheres for ball bearings) and carbon spheres (carbon-steel spheres); stainless-steel spheres; ceramic spheres such as silicon nitride spheres, silicon carbide, zirconia, and alumina; and spheres coated with a film of titanium nitride, titanium carbonitride, etc. Preferred of these are ceramic spheres. Especially preferred are zirconia beads. More specifically, it is preferred to use burned zirconia beads, in particular, the burned zirconia beads described in Japanese Patent No. 3400836.

<Dispersion Method>

In the coating fluid for photosensitive-layer formation which contains a charge-generating material and a binder resin, the charge-generating material is present in the state of being dispersed in the coating fluid. For dispersing the charge-generating material in the coating fluid, use can be made of a method in which the dispersing medium is used to disperse the charge-generating material in an organic solvent by a wet process by means of a known pulverizer or dispersing apparatus. Examples of the known pulverizer or dispersing apparatus include known mechanical pulverizers such as a ball mill, sand grinding mill, planetary mill, and roll mill and dispersing apparatus such as a pebble mill, ball mill, sand mill, screen mill, gap mill, vibrating mill, paint shaker, and attritor.

Preferred of these is one in which the charge-generating material can be dispersed while circulating the coating fluid. Wet type ball mills, e.g., a sand mill, screen mill, and gap mill, are preferred from the standpoints of dispersing efficiency, fineness of the attainable particle diameter, ease of continuous operation, etc. These mills may be either vertical or horizontal. Such mills can have any desired disk shape such as, e.g., the flat plate type, vertical pin type, or horizontal pin type. It is preferred to use a sand mill of the liquid circulation type.

A preferred wet type ball mill is one which has a cylindrical stator, a slurry feed opening formed in one end of the stator, a slurry discharge opening formed in another end of the stator, a rotor of the pin, disk, or annular type for stirring/mixing the dispersing medium to be packed in the stator and a slurry which is to be fed through the slurry feed opening and contains the charge-generating material and the binder resin, and a separator connected to the slurry discharge opening and serving to separate the slurry from the dispersing medium by the action of centrifugal force and discharge the separated slurry through the slurry discharge opening, and in which the separator is rotated/driven with a shaft, the axial center of the shaft having a hollow discharge passage connected to the slurry discharge opening.

The separator used here preferably is one disposed rotatably, and desirably is of the impeller type. The separator has been united with the rotor to rotate therewith, or rotates separately from and independently of the rotor. The separator functions to separate the slurry from the dispersing medium by the action of the centrifugal force caused by the rotation of the separator.

In this wet type stirring ball mill, the slurry separated from the dispersing medium by the separator is discharged through the hollow discharge passage in the axial center of the shaft. Because no centrifugal force acts on this slurry in the axial center of the shaft, the slurry is discharged in the state of having no kinetic energy. Consequently, use of the wet type stirring ball mill has an effect that kinetic energy is not uselessly given off and a power is prevented from uselessly consumed.

This wet type stirring ball mill may be either horizontal or vertical. However, from the standpoint of heightening the degree of packing with the dispersing medium, the ball mill preferably is vertical and the slurry discharge opening is preferably disposed at the upper end of the mill. Furthermore, it is also preferred that the separator be disposed above the dispersing-medium packing level. In the case where the slurry discharge opening is disposed at the upper end of the mill, the slurry feed opening is disposed in a bottom part of the mill.

In a preferred embodiment, the slurry feed opening is constituted of a valve seat and a V-shaped, trapezoidal, or cone-shaped valve plug which is fitted in the valve seat so as to be capable of ascending and descending and of coming into line contact with the edge of the valve seat. An annular slit which does not permit the dispersing medium to pass therethrough is formed between the edge of the valve seat and the V-shaped, trapezoidal, or cone-shaped valve plug, whereby a raw slurry can be fed through the slit while preventing the dispersing medium from falling through it. It is possible to discharge the dispersing medium by causing the valve plug to ascend and thereby widening the slit, or it is possible to close the mill by causing the valve plug to descend and thereby closing the slit. Furthermore, since the slit is formed by the valve plug and the edge of the valve seat, coarse particles present in the raw slurry are less apt to be caught in the slit. Even when coarse particles are caught, they readily go out of the slit upward or downward. This constitution has an advantage of being less apt to cause clogging.

The valve plug may be constituted so as to be vertically vibrated by a vibrating device, whereby coarse particles which have been caught in the slit can be removed therefrom and particle catching itself is less apt to occur. In addition, the vibration of the valve plug applies a shear force to the raw slurry to reduce the viscosity thereof, whereby the amount of the raw slurry which passes through the slit, i.e., feed amount, can be increased. As the vibrating device which vibrates the valve plug, use can be made of a mechanical device such as, e.g., a vibrator or a device which fluctuates the pressure of the compressed air acting on a piston united with the valve plug, such as, e.g., a reciprocating compressor or an electromagnetic switching valve which changes the flow of the compressed air between introduction and discharge.

It is desirable that a screen for dispersing medium separation and a takeout opening for a product slurry should be disposed in a bottom part of the wet type stirring ball mill so that the product slurry remaining in the mill after a dispersing treatment can be taken out.

Namely, the vertical wet type stirring ball mill comprises: a cylindrical vertical stator which has a slurry feed opening formed in a bottom part of the stator and a slurry discharge opening formed at the upper end of the stator; a shaft which is pivotally supported by the upper end of the stator and is rotated/driven by a driving means, e.g., a motor; a pin, disk, or annular type rotor fixed to the shaft and serving to stir/mix a dispersing medium to be packed in the stator and a slurry which is to be fed through the slurry feed opening and contains the charge-generating material and the binder resin; a separator disposed near the slurry discharge opening and serving to separate the dispersing medium from the slurry; and a mechanical seal disposed in a bearing part movably supporting that part of the shaft which is located at the upper end of the stator. In this vertical wet type stirring ball mill, it is preferred that the annular groove into which the O-ring in contact with a mating ring of the mechanical seal is fitted should have, formed in a lower side part thereof, a tapered incision expanding downward.

In this wet type stirring ball mill, the mechanical seal has been disposed in the shaft center part, where the dispersing medium and the slurry have almost no kinetic energy, and at the upper stator end, which is located above the liquid level of these. Because of this, the inclusion of the dispersing medium or slurry into the space between the mating ring of the mechanical seal and the lower side part of the O-ring fitting groove can be considerably diminished.

In addition, because the lower side part of the annular groove into which the O-ring fits expands downward due to the incision and has an increased clearance, the slurry and dispersing medium which have come into the groove are less apt to stick or solidify to cause clogging. The mating ring smoothly conforms to the seal ring and the function of the mechanical seal is maintained. Incidentally, the lower side part of the fitting groove into which the O-ring fits has a V-shaped section and this fitting part as a whole does not have a reduced thickness. The fitting part hence neither has an impaired strength nor is impaired in the function of holding the O-ring.

In the wet type stirring ball mill, it is preferred that the separator should comprise two disks having blade-fitting grooves on the opposed inner sides thereof, blades interposed between the disks and fitted in the fitting grooves, and a supporting means which holds from both sides the disks having the blades interposed therebetween. In a preferred embodiment, the supporting means is constituted of a step of the shaft as a stepped shaft and a cylindrical presser which has been put on the shaft and presses the disks. In this constitution, the disks having the blades interposed therebetween are sandwiched from both sides between and supported by the step of the shaft and the presser.

FIG. 1 is a sectional view illustrating one example of the vertical wet type stirring ball mill. In FIG. 1, a raw slurry is fed to the wet type stirring ball mill and is stirred together with a dispersing medium in the mill to pulverize the charge-generating material. Thereafter, the dispersing medium is separated with a separator 14, and the slurry is discharged through the center of the shaft 15, follows a return passage, and is circulated for pulverization.

As shown in FIG. 1 in detail, this vertical wet type stirring ball mill comprises: a stator 17 which has a vertical cylindrical shape and is equipped with a jacket 16 for passing cooling water for cooling the mill; a shaft 15 which is located at the axial center of the stator 17, is rotatably supported with a bearing in an upper part of the stator, and has a mechanical seal in the bearing part and in which an upper axial central part thereof constitutes a hollow discharge passage 19; pin- or disk-form rotors 21 projecting in radial directions from a lower end part of the shaft; a pulley 24 fixed to an upper part of the shaft and transferring a driving force; a rotary joint 25 attached to the open upper end of the shaft; a separator 14 for dispersing-medium separation which has been fixed to the shaft 15 in an area near an upper part in the stator; a raw-slurry feed opening 26 disposed in the stator bottom so as to face the end of the shaft 15; and a screen 28 for dispersing-medium separation which has been attached to the upper side of a screen support 27 in a lattice form disposed in a product slurry takeout opening 29 formed in an eccentric position in the stator bottom.

The separator 14 comprises a pair of disks 31 fixed to the shaft 15 so as to be apart from each other at a given distance and blades 32 connecting the two disks 31 to each other. The separator 14 thus constitutes an impeller. It rotates together with the shaft 15 and applies a centrifugal force to the dispersing medium and slurry which have come into the space between the disks. As a result, the dispersing medium is driven outward in radial directions based on a difference in specific gravity between the slurry and the dispersing medium. On the other hand, the slurry is discharged through the discharge passage 19 in the center of the shaft 15. The raw-slurry feed opening 26 comprises: a valve plug 35 of an inverted-trapezoid shape which fits into a valve seat in the stator bottom so as to be capable of ascending and descending; and a bottomed cylindrical body 36 projecting downward from the stator bottom. The valve plug 35 is pushed up by the feeding of a raw slurry to form an annular slit between the valve plug 35 and the valve seat, whereby the raw slurry is fed into the mill.

When a raw slurry is fed, the valve plug 35 ascends due to the feeding pressure which is being applied to the raw slurry sent into the cylindrical body 36, while opposing the pressure in the mill, to form a slit between the valve plug 35 and the valve seat.

For the purpose of avoiding slit clogging, the valve plug 35 is constituted so as to repeat a vertical motion in which the valve plug 35 ascends to an upper limit position at a short period. Such vertical vibrations can eliminate particle catching. These vibrations of the valve plug 35 may be always conducted or may be conducted when the raw slurry contains coarse particles in a large amount. Furthermore, the vibrations may be conducted at the time when the raw-slurry feeding pressure has increased due to clogging.

Specific examples of the wet type stirring ball mill having such a structure include Ultra Apex Mill, manufactured by Kotobuki Industries Co., Ltd.

An explanation is then given on a method of pulverizing a raw slurry. A dispersing medium is packed into the stator 17 of the ball mill, and the rotors 21 and the separator 14 are rotated/driven by an external power. On the other hand, a raw slurry is sent in a given amount to the slurry feed opening 26, whereby the raw slurry is fed into the mill through a slit formed between the edge of the valve seat and the valve plug 35.

The rotation of the rotor 21 stirs/mixes the raw slurry and dispersing medium present in the mill, whereby the slurry is pulverized. Furthermore, due to the rotation of the separator 14, the dispersing medium and slurry which have come into the separator are separated from each other based on a difference in specific gravity. The dispersing medium, which has a higher specific gravity, is driven outward in radial directions, whereas the slurry, which has a lower specific gravity, is discharged through the discharge passage 19 formed in the center of the shaft 15 and is returned to a feedstock tank. In a stage in which pulverization has proceeded to some degree, the slurry is suitably examined for particle size. At the time when a desired particle size has been reached, the feed pump is temporarily stopped and the operation of the mill is then stopped to terminate the pulverization.

In the case where such a vertical wet type stirring ball mill is used to disperse a particulate charge-generating material, the degree of packing of the dispersing medium in the mill during the pulverization is preferably 50-100%, more preferably 70-95%, especially preferably 80-90%.

The wet type stirring ball mill to be used for a dispersion process in preparing a coating fluid for photosensitive-layer formation according to the invention may be one in which the separator is a screen or a slit mechanism. However, the separator desirably is of the impeller type and the mill preferably is vertical. Although the wet type stirring ball mill desirably is a vertical one having the separator disposed in an upper part of the mill, the regulation of the degree of packing of the dispersing medium especially to 60-90% not only enables pulverization be conducted most efficiently but also produces the following effect. The separator can be disposed in a position above the packing level of the dispersing medium, whereby the dispersing medium can be prevented from coming onto the separator and being discharged.

Operating conditions for the wet type stirring ball mill to be used for a dispersion process in producing a coating fluid for photosensitive-layer formation according to the invention exert influences on the volume-average particle diameter of charge-generating material aggregates, i.e., secondary particles, in the coating fluid, stability of the coating fluid, surface shape of a photosensitive layer (charge-generating layer) to be formed by applying the coating fluid, and properties of an electrophotographic photoreceptor having the photosensitive layer (charge-generating layer) to be formed by applying the coating fluid. Examples of factors which are especially highly influential include the rate of feeding the coating fluid and the rotation speed of the rotor.

The rate of feeding the coating fluid for photosensitive-layer formation is influenced by the capacity and shape of the mill because it relates to the time period over which the coating fluid for undercoat layer formation resides in the mill. In the case where the stator is of the type in common use, the rate of feeding is preferably in the range of from 20 kg/hr to 80 kg/hr, more preferably in the range of from 30 kg/hr to 70 kg/hr, per liter (hereinafter often abbreviated to L) of the mill capacity.

In the case where a wet type stirring ball mill is used for dispersing a charge-generating material such as, e.g., a phthalocyanine pigment, there are no limitations on the degree of packing of the dispersing medium in the wet type stirring ball mill and any desired degree of packing may be employed as long as the charge-generating material can be dispersed to such a degree as to result in a desired particle size distribution. However, in the case where a vertical wet type stirring ball mill such as that desired above is used for dispersing the charge-generating material, the degree of packing of the dispersing medium in the wet type stirring ball mill is generally 50% or higher, preferably 70% or higher, more preferably 80% or higher, and is generally 100% or lower, preferably 95% or lower, more preferably 90% or lower.

On the other hand, the rotation speed of the rotors is influenced by the shape of the rotors, distance between each rotor and the stator, etc. However, in the case where the stator and rotors are of the types in common use, the peripheral speed of the rotor peripheries is preferably in the range of from 5 m/sec to 20 m/sec, more preferably in the range of from 8 m/sec to 15 m/sec, especially from 10 m/sec to 12 m/sec.

The dispersing medium is generally used in an amount of from 0.5-5 times by volume the amount of the coating fluid for photosensitive-layer formation. Besides the dispersing medium, a dispersing agent which can be easily removed after the dispersion process may be used in combination therewith. Examples of the dispersing agent include common salt and Glauber's salt.

It is preferred that the charge-generating material should be dispersed by a wet process in the presence of a dispersion solvent. However, a binder resin and various additives may be mixed simultaneously therewith. Although the solvent is not particularly limited, use of the same organic solvent as that for use in a coating fluid for undercoat layer formation is preferred because this eliminates the necessity of conducting the step of, e.g., solvent exchange after the dispersion process. The solvent to be used may consist of a single compound or may be a mixed solvent comprising a combination of two or more compounds.

In particular, it is preferred that Y-form oxytitanium phthalocyanine, which is susceptible to crystal transformation, or the like should be dispersed in the presence of a binder resin.

From the standpoint of productivity, the amount of the solvent to be used per part by weight of the charge-generating material to be dispersed is generally 0.1 part by weight or larger, preferably 1 part by weight or larger, and is generally 500 parts by weight or smaller, preferably 100 parts by weight or smaller. With respect to temperature during the mechanical dispersion process, the charge-generating material can be dispersed at a temperature which is not lower than the solidifying point of the solvent (or mixed solvent) and not higher than the boiling point thereof. However, the dispersion process is generally conducted at a temperature in the range of from 0° C. to 200° C. from the standpoint of safety in production. Especially for Y-form oxytitanium phthalocyanine, which has the property shown above, or the like, a low temperature of from 0° to 20° is preferred.

After the dispersing treatment with a dispersing medium, the dispersing medium is separated/removed and the coating fluid is preferably further subjected to an ultrasonic treatment. In the ultrasonic treatment, in which ultrasonic vibrations are applied to the coating fluid for photosensitive-layer formation, there are no particular limitations on vibration frequency, etc. Ultrasonic vibrations may be applied with an oscillator having a frequency of generally from 10 kHz to 40 kHz, preferably from 15 kHz to 35 kHz.

The output of the ultrasonic oscillator is not particularly limited. However, an oscillator of from 100 W to 5 kW is generally used. In general, the ultrasonic treatment of a small amount of a coating fluid with a low-output ultrasonic oscillator is superior in dispersion efficiency to the ultrasonic treatment of a large amount of the coating fluid with a high-output ultrasonic oscillator. Because of this, the amount of the coating fluid for photosensitive-layer formation to be treated at a time is preferably 1-50 L, more preferably 5-30 L, especially preferably 10-20 L. In this case, the output of the ultrasonic oscillator is preferably from 200 W to 3 kW, more preferably from 300 W to 2 kW, especially preferably from 500 W to 1.5 kW.

Methods for applying ultrasonic vibrations to the coating fluid for photosensitive-layer formation are not particularly limited. Examples thereof include a method in which an ultrasonic oscillator is directly immersed in a container containing the coating fluid; a method in which an ultrasonic oscillator is brought into contact with the outer wall of a container containing the coating fluid; and a method in which a solution containing the coating fluid is immersed in a liquid which is being vibrated with an ultrasonic oscillator.

Preferred of those methods is the method in which a solution containing the coating fluid is immersed in a liquid which is being vibrated with an ultrasonic oscillator. In this case, examples of the liquid to be vibrated with an ultrasonic oscillator include water; alcohols such as methanol; aromatic hydrocarbons such as toluene; and fats and oils such as silicone oils. However, it is preferred to use water when safety in production, cost, cleanability, etc. are taken into account. In the method in which a solution containing the coating fluid is immersed in a liquid which is being vibrated with an ultrasonic oscillator, the efficiency of ultrasonic treatment varies with the temperature of the liquid. It is therefore preferred to keep the temperature of the liquid constant. There are cases where the temperature of the liquid being vibrated increases due to the ultrasonic vibrations applied. The temperature of the liquid in conducting the ultrasonic treatment preferably is in the range of generally 5-60° C., preferably 10-50° C., more preferably 15-40° C.

The container for containing the coating fluid in conducting the ultrasonic treatment may be any container as long as it is in common use for containing a coating fluid for forming the photosensitive layer of an electrophotographic photoreceptor. Examples thereof include containers made of a resin such as polyethylene or polypropylene, containers made of a glass, and metallic cans. Preferred of these are metallic cans. Especially preferred is an 18-L metallic can as provided for in JIS Z 1602. This is because the metallic can is less apt to be attacked by organic solvents and has high impact strength.

According to need, the coating fluid for photosensitive-layer formation is used after having been filtered in order to remove coarse particles. In this case, the filtering medium to be used may be any of filtering materials in common use for filtration, such as cellulose fibers, resin fibers, and glass fibers. With respect to the form of the filtering medium, it preferably is a so-called wound filter comprising a core material and fibers of any of various kinds wound around the core material, for example, because this filter has a large filtration area to attain a satisfactory efficiency. The core material to be used can be any of known core materials. However, examples thereof include stainless-steel core materials and core materials made of a resin which does not dissolve in the coating fluid for photosensitive-layer formation, such as, e.g., polypropylene.

The coating fluid for photosensitive-layer formation thus produced is used for forming a charge-generating layer optionally after a binder, various aids, etc. are further added thereto. The method described herein under <Dispersion Method> is exceedingly effective also in producing the coating fluid for undercoat layer formation which will be described later. It is preferred to use such coating fluids in combination.

<Coating Fluid for Photosensitive-Layer Formation>

The coating fluid of the invention, which is for forming a photosensitive layer of an electrophotographic photoreceptor, is one which has undergone a dispersing treatment conducted by the dispersion method described above.

Although it is desirable that the charge-generating material in the coating fluid for photosensitive-layer formation should be present as primary particles, such as a case is rare. In most cases, the charge-generating material has aggregated into secondary aggregate particles, or primary particles and the secondary particles coexist. Consequently, what particle size distribution the charge-generating material has in that state is exceedingly important. Especially when the charge-generating material is a phthalocyanine pigment, it is preferred that the particulate charge-generating material (hereinafter often referred to as charge-generating particles) in the coating fluid should have a 50% cumulative particle diameter (referred to also as cumulative median diameter or as median diameter) D50 of 0.13 μm or smaller. The charge-generating material regulated so as to have a median diameter in that range is less apt to precipitate in the coating fluid and to cause a viscosity change and, as a result, the coating fluid can give a photosensitive layer having an even film thickness and even surface properties. On the other hand, in case where the 50% cumulative particle diameter D50 of the charge-generating particles, which is determined by the dynamic light scattering method, exceeds 0.13 μm, the charge-generating particles in the coating fluid are highly apt to precipitate and cause a large viscosity change. As a result, this coating fluid gives a photosensitive layer which has an uneven film thickness and uneven surface properties and hence exerts adverse influences on quality. Consequently, such too large values of D50 are undesirable. The 50% cumulative particle diameter of the charge-generating material is more preferably 0.12 μm or smaller. Incidentally, too small particle diameters deprive the charge-generating particles of the interaction among these. Consequently, the 50% cumulative particle diameter of the charge-generating material is preferably 0.02 μm or larger, more preferably 0.03 μm or larger.

The 90% cumulative particle diameter D90 of the charge-generating material is preferably 0.25 μm or smaller. The absolute value of the difference between the 90% cumulative particle diameter and the 50% cumulative particle diameter (D90-D50) is preferably 0.10 μm or smaller, more preferably 0.08 μm or smaller.

In the invention, the definitions of the "50% cumulative particle diameter" and "90% cumulative particle diameter" of a charge-generating material are as follows. Based on an examination for particle size distribution by the dynamic light scattering method, a volume-cumulative particle size distribution curve from the smaller-particle-diameter side is determined, with the total volume of the charge-generating particles as the charge-generating material being 100%. The particle diameter at the 50% point in this cumulative curve and the particle diameter at the 90% point in the cumulative curve are defined as the 50% cumulative particle diameter and the 90% cumulative particle diameter, respectively.

The present inventors have found that a coating fluid in which the charge-generating particles have a 50% cumulative particle diameter, 90% cumulative particle diameter, and D90-D50 in the respective ranges is less apt to suffer gelation or a viscosity change, can be stored over long, and hence gives a photosensitive layer having an even film thickness and even surface properties. On the other hand, in case where the charge-generating particles in the coating fluid do not satisfy any of those requirements concerning particle size, the coating fluid is highly apt to gel and undergoes a large viscosity change. As a result, this coating fluid gives a photosensitive layer which has an uneven film thickness and uneven surface properties and hence exerts adverse influences on quality. Consequently, such state of the charge-generating particles is undesirable.

In the dynamic light scattering method, the speed of the Brownian movement of finely dispersed particles is determined by irradiating the particles with a laser light and detecting the scattering of lights differing in phase according to the speed (Doppler shift) to determine a particle size distribution. The values of volume particle diameter of the charge-generating particles in the coating fluid for photosensitive-layer formation of the invention mean values for the charge-generating particles which are in the state of being stably dispersed in the coating fluid, and mean neither particle diameters of the charge-generating particles in a powder state which have not been dispersed nor particle diameters of a wet cake. An actual examination for determining the 50% cumulative particle diameter D50 is made specifically with a particle size distribution analyzer operated by the dynamic light scattering method (MICROTRAC UPA Model 9340-UPA; manufactured by Nikkiso Co., Ltd.; hereinafter abbreviated to UPA) under the following conditions. This particle size distribution analyzer was operated according to the operating manual therefor (issued by Nikkiso Co., Ltd.; Document No. T15-490A00, revision No. E).

Upper limit of measurement: 5.9978 μm
Lower limit of measurement: 0.0035 μm
Number of channels: 44
Examination period: 300 sec
Particle transparency: absorption
Refractive index of particle: N/A (not applied)
Particle shape: non-spherical
Kind of dispersion medium:
Dimethoxyethane/4-methoxy-4-methyl-2-pentanone=9/1 in the case of phthalocyanine pigment
Dimethoxyethane in the case of azo pigment
Refractive index of dispersion medium: 1.35
Density: 1.60 (g/cm$^3$; phthalocyanine pigment) 48 (g/cm$^3$; azo pigment)

Before being examined, a sample was diluted with the dispersion medium so as to result in a sample concentration index (SIGNAL LEVEL) of 0.6-0.8. The sample diluted was examined at 25° C.

<Method of Forming Photosensitive Layer>

A photosensitive layer (charge-generating layer in the case of a lamination type photosensitive layer) is formed by applying the coating fluid for photosensitive-layer formation of the invention on a support, usually on an undercoat layer formed on a conductive support, by a known coating technique, such as, e.g., dip coating, spray coating, nozzle coating, spiral coating, ring coating, bar coating, roll coating, or blade coating, and drying the coating fluid applied.

Examples of the spray coating include air spraying, airless spraying, electrostatic air spraying, electrostatic airless spraying, rotary atomization type electrostatic spraying, hot spraying, and hot airless spraying. However, when the degree of reduction into fine particles, which is necessary for obtaining an even film thickness, efficiency of adhesion, etc. are taken into account, it is preferred to use rotary atomization type electrostatic spraying in which the conveyance method disclosed in Domestic Re-publication of PCT Patent Application No. 1-805198, i.e., a method in which cylindrical works are successively conveyed while rotating these without spacing these in the axial direction, is used. Thus, a photosensitive layer having excellent evenness in film thickness can be obtained while attaining a comprehensively high degree of adhesion.

Examples of the spiral coating include the method employing a cast coater or curtain coater disclosed in JP-A-52-119651, the method in which a coating material is continuously ejected in a streak form through a minute opening as disclosed in JP-A-1-231966, and the method employing a multinozzle structure as disclosed in JP-A-3-193161.

In the case of dip coating, the coating fluid for photosensitive-layer formation usually has a total solid concentration which is generally 1% by weight or higher, preferably 2% by weight or higher, and is generally 10% by weight or lower, preferably 5% by weight or lower. The viscosity of the coating fluid for photosensitive-layer formation is regulated to a value which is preferably 0.1 mPa·s or higher, more preferably 0.5 mPa·s or higher, and is preferably 100 mPa·s or lower, more preferably 20 mPa·s or lower.

The surface shape of the photosensitive layer formed through coating-fluid application is characterized by in-plane root mean square roughness (RMS), in-plane arithmetic mean roughness (Ra), and in-plane maximum roughness (P-V). These are values obtained in accordance with JIS B 0601:2001 by extending the root mean square height, arithmetic mean height, and maximum height for a sampling length to values for a sampling area, and can be expressed with Z(x), which is height-direction values in the sampling area. The in-plane root mean square roughness (RMS) represents the root mean square of Z(x), the in-plane arithmetic mean roughness (Ra) represents the average of the absolute values of Z(x), and the in-plane maximum roughness (P-V) represents the sum of the maximum peak-height value of Z(x) and the maximum valley-depth value of Z(x). In the invention, the in-plane root mean square roughness (RMS) of the photosensitive layer is generally in the range of 10-100 nm, preferably in the range of 20-50 nm. The in-plane arithmetic mean roughness (Ra) of the photosensitive layer in the invention is generally in the range of 10-50 nm, preferably in the range of 10-50 nm. Furthermore, the in-plane maximum roughness (P-V) of the photosensitive layer in the invention is generally in the range of 100-1,000 nm, preferably in the range of 300-800 nm.

Those numerical values concerning surface shape may be ones determined with any surface shape analyzer as long as the surface irregularities in a sampling area can be highly precisely measured with the surface shape analyzer. It is, however, preferred that surface irregularities in a sample surface be detected with a light interference microscope based on a combination of the high-precision phase shift detection method and order calculation for interference fringes. More specifically, it is preferred to examine the surface with Micromap, manufactured by Ryoka Systems Inc., in the wave mode by the interference fringe addressing method.

[Electrophotographic Photoreceptor]

The electrophotographic photoreceptor according to the invention comprises a conductive support and a photosensitive layer formed thereover from the coating fluid for photosensitive-layer formation described above. The photosensitive layer formed has functions such as sensitivity impartation, improvement in adhesion to the conductive support (or to the undercoat layer when it is possessed), reduction in unevenness of electrical properties, prevention of a surface potential decrease with repetitions of use, and prevention of local surface potential fluctuations causative of image defects. It is a layer essential for the impartation of photoelectrical properties.

The photosensitive layer as a component of the electrophotographic photoreceptor of the invention can have any constitution applicable to known electrophotographic photoreceptors as long as it comprises a layer having the function of generating charges. Examples thereof include the so-called single-layer type photosensitive layer, which comprises a single photosensitive layer comprising a binder resin and photoconductive materials (e.g., a charge-generating material and a charge-transporting material) dissolved or dispersed therein; and the so-called lamination type photosensitive layer composed of two or more superposed layers comprising a charge-generating layer containing a charge-generating material and a charge-transporting layer containing a charge-transporting material. It is generally known that photoconductive materials each show the same performances regardless of whether they are used in the single-layer type or in the lamination type. In the case of the single-layer type, the photosensitive layer as a whole serves as a charge-generating layer.

Although the photosensitive layer in the electrophotographic photoreceptor of the invention may have any known constitution, it preferably is a lamination type photoreceptor when the mechanical properties, electrical properties, production stability, etc. of the photoreceptor are comprehensively taken into account. More preferably, the photosensitive layer is a normal lamination type photosensitive layer comprising a charge-generating layer, a charge-generating layer, and a charge-transporting layer which have been superposed in this order over a conductive support.

The electrophotographic photoreceptor of the invention is an electrophotographic photoreceptor comprising a conductive support and a photosensitive layer (charge-generating layer) formed thereover which comprises a charge-generating material and a binder resin. In this electrophotographic photoreceptor, the coating fluid used for forming the photosensitive layer has the following features:

(1) the charge-generating material has been dispersed with a dispersing medium having an average particle diameter of from 1.0 μm to 350 μm;

(2) the dispersing medium comprises zirconia beads;

(3) the process of dispersion is one conducted by means of a ball mill;

(4) the coating fluid is one obtained through a dispersing treatment with a wet type stirring ball mill which has: a cylindrical stator; a slurry feed opening formed in one end of the stator; a slurry discharge opening formed in another end of the stator; a rotor for stirring/mixing the dispersing medium to be packed in the stator and a slurry which is to be fed through the slurry feed opening and contains the charge-generating material and the binder resin; and a separator connected to the slurry discharge opening and serving to separate the slurry from the dispersing medium by the action of centrifugal force and discharge the separated slurry through the slurry discharge opening, and in which the separator is rotated/driven with a shaft, the axial center of the shaft having a hollow discharge passage connected to the slurry discharge opening;

(5) the coating fluid is one obtained through a dispersing treatment with a wet type stirring ball mill which has: a cylindrical stator; a slurry feed opening formed in one end of the stator; a slurry discharge opening formed in another end of the stator; a rotor for stirring/mixing the dispersing medium to be packed in the stator and a slurry which is to be fed through the slurry feed opening and contains the charge-generating material and the binder resin; and a separator connected to the slurry discharge opening and serving to separate the slurry from the dispersing medium by the action of centrifugal force and discharge the separated slurry through the slurry discharge opening, and in which the separator comprises two disks having blade-fitting grooves on the opposed inner sides thereof, blades interposed between the disks and fitted in the fitting grooves, and a supporting means which holds from both sides the disks having the blades interposed therebetween; and (6) the charge-generating material (phthalocyanine pigment) in the coating fluid has a 50% cumulative particle diameter D50 as determined by the dynamic light scattering method of 0.13 μm or smaller.

<Conductive Support>

As the conductive support is mainly used, for example, a metallic material such as aluminum, an aluminum alloy, stainless steel, copper, or nickel, a resinous material to which electrical conductivity has been imparted by adding a conductive powder such as a metal, carbon, or tin oxide, or a resin, glass, paper, or the like which has a surface coated with a conductive material, e.g., aluminum, nickel, or ITO (indium-tin oxide), by vapor deposition or coating fluid application. With respect to shape, a conductive support in a drum, sheet, belt, or another form may be used. Use may also be made of a metallic conductive support coated with a conductive material having an appropriate resistance value for the purpose of regulating conductivity, surface properties, or other properties or covering defects.

In the case where a metallic material such as, e.g., an aluminum alloy is employed as a conductive support, it may be used after having been subjected to an anodization treatment. It is desirable that when an anodization treatment is performed, the support be then subjected to a pore-filling treatment by a known method.

For example, an anodized coating film is formed by conducting an anodization treatment in an acidic bath such as, e.g., a chromic acid, sulfuric acid, oxalic acid, boric acid, or sulfamic acid bath. However, an anodization treatment in sulfuric acid gives better results. In the case of an anodization treatment in sulfuric acid, conditions are preferably regulated in such a range as to include a sulfuric acid concentration of 100-300 g/L, dissolved-aluminum concentration of 2-15 g/L, liquid temperature of 15-30° C., electrolysis voltage of 10-20 V, and current density of 0.5-2 A/dm$^2$. However, the conditions should not be construed as being limited to these.

It is preferred that the anodized coating film thus formed should be subjected to a pore-filling treatment. Although the pore-filling treatment may be conducted by a known method, it is preferred to conduct, for example, a low-temperature pore-filling treatment in which the coating film is immersed in an aqueous solution containing nickel fluoride as a major ingredient or a high-temperature pore-filling treatment in which the coating film is immersed in an aqueous solution containing nickel acetate as a major ingredient.

The concentration of the aqueous nickel fluoride solution to be used in the low-temperature pore-filling treatment can be suitably selected. However, the solution gives better results when used in a concentration in the range of 3-6 g/L. From the standpoint of enabling the pore-filling treatment to proceed smoothly, the treatment temperature is generally 25° C. or higher, preferably 30° C. or higher, and is generally 40° C. or lower, preferably 35° C. or lower, and the pH of the aqueous nickel fluoride solution is generally 4.5 or higher, preferably 5.5 or higher, and is generally 6.5 or lower, preferably 6.0 or lower. As a pH regulator, use may be made of oxalic acid, boric acid, formic acid, acetic acid, sodium hydroxide, sodium acetate, ammonia water, or the like. With respect to treatment period, the coating film is preferably treated for a period of 1-3 minutes per μm of the coating film thickness. For the purpose of further improving coating film properties, cobalt fluoride, cobalt acetate, nickel sulfate, a surfactant, etc. may be added to the aqueous nickel fluoride solution beforehand. Subsequently, the support is washed with water and dried to complete the low-temperature pore-filling treatment.

In the case of the high-temperature pore-filling treatment, use may be made of an aqueous solution of a metal salt such as nickel acetate, cobalt acetate, lead acetate, nickel-cobalt acetate, or barium nitrate. However, it is especially preferred to use nickel acetate. In the case of using an aqueous nickel acetate solution, the concentration thereof is preferably in the range of 5-20 g/L. The treatment temperature is generally 80° C. or higher, preferably 90° C. or higher, and is generally 100° C. or lower, preferably 98° C. or lower. The pH of the aqueous nickel acetate solution is preferably in the range of 5.0-6.0. As a pH regulator for this treatment, use may be made of ammonia water, sodium acetate, or the like. The treatment period is preferably 10 minutes or longer, more preferably 15 minutes or longer. In this case also, sodium acetate, an organic carboxylic acid, an anionic or nonionic surfactant, and the like may be added to the aqueous nickel acetate solution in order to improve coating film properties. Furthermore, the coating film may be treated with high-temperature water or high-temperature water vapor each containing substantially no salt. Subsequently, the support is washed with water and dried to complete the high-temperature pore-filling treatment.

In the case where the anodized coating film has a large average thickness, severer pore-filling conditions including a higher pore-filling solution concentration, higher treatment temperature, and longer treatment period are necessary. Consequently, not only productivity is impaired but also the coating film surface is apt to develop surface defects such as spots, soils, or powdering. From such standpoints, it is preferred that an anodized coating film be formed so as to have an average thickness of generally 20 μm or smaller, especially 7 μm or smaller.

The surface of the conductive support may be smooth or may have been roughened by a special cutting technique or abrading treatment. Alternatively, the conductive support may be one having a roughened surface obtained by incorporating particles having an appropriate particle diameter into the material constituting the support. Furthermore, a drawn tube as it is may be used as a conductive support, without being subjected to cutting, for the purpose of cost reduction. In particular, use of an aluminum support obtained through a non-cutting processing such as drawing, impacting, ironing, or the like is preferred because the processing eliminates adherent substances present on the surface, e.g., fouling or foreign matters, minute mars, etc. and an even and clean support is obtained.

<Undercoat Layer>

An undercoat layer may be disposed between the conductive support and the photosensitive layer in order to improve adhesion, blocking properties, etc. As the undercoat layer may be used a resin alone or a composition comprising a resin and particles of, e.g., a metal oxide dispersed therein. The undercoat layer may consist of a single layer or may be composed of two or more layers.

Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing two or more metallic elements, such as calcium titanate, strontium titanate, or barium titanate. Particles of one kind selected from these may be used alone, or a mixture of any desired combination of two or more of such particulate materials in any desired proportion may be used. Preferred of those particulate metal oxides are titanium oxide and aluminum oxide. Titanium oxide is especially preferred. The titanium oxide particles may be ones whose surface has undergone a treatment with an inorganic substance such as tin oxide, aluminum oxide, antimony oxide, zirconium oxide, or silicon oxide or with an organic substance such as stearic acid, a polyol, or a silicone. The particle surface may have been treated with any one of these or with two or more thereof. With respect to the crystal form of the titanium oxide particles, any of the rutile, anatase, brookite, and amorphous forms is possible. The titanium oxide particles may have one crystal form only or comprise any desired combination of two or more crystal forms in any desired proportion.

The metal oxide particles to be used can have a particle diameter in a wide range. However, from the standpoints of properties of, e.g., the binder resin as a raw material for the undercoat layer and of coating-fluid stability, metal oxide particles having an average primary-particle diameter of generally from 10 nm to 100 nm, preferably to 50 nm, are especially desirable. This value of primary particle diameter is one obtained from a TEM photograph.

It is desirable that an undercoat layer be formed so as to be constituted of a binder resin and metal oxide particles dispersed therein. Examples of the binder resin for use in the undercoat layer include epoxy resins, polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, poly(vinyl acetal) resins, vinyl chloride/vinyl acetate copolymers, poly (vinyl alcohol) resins, polyurethane resins, poly(acrylic acid) resins, polyacrylamide resins, polyvinylpyrrolidone resins, polyvinylpyridine resins, water-soluble polyester resins, cellulose ester resins such as nitrocellulose, cellulose ether resins, casein, gelatin, poly(glutamic acid), starch, starch acetate, aminostarch, organozirconium compounds such as zirconium chelate compounds and zirconium alkoxide compounds, organotitanium compounds such as titanium chelate compounds and titanium alkoxide compounds, and silane coupling agents. These may be used alone, or any desired combination of two or more thereof in any desired proportion may be used. The binder resin may be in a cured form obtained by using a curing agent therewith. Of the resins enumerated above, alcohol-soluble copolyamides and modified polyamides are preferred because such polyamides have satisfactory dispersing properties and satisfactory applicability.

Especially preferred of these polyamide resins is a copolyamide resin containing constituent units of a diamine represented by the following general formula (1).

[Ka-5]

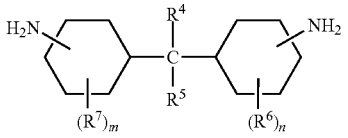

(1)

In general formula (1), $R^4$ to $R^7$ represent a hydrogen atom or an organic substituent. Symbols m and n each independently represent an integer of 0 to 4. When two or more substituents are presents, these substituents may be different from each other. The substituents represented by $R^4$ to $R^7$ each preferably are a hydrocarbon group which has up to 20 carbon atoms and may contain one or more heteroatoms. More preferred examples thereof include alkyl groups such as methyl, ethyl, n-propyl, and isopropyl; alkoxy groups such as methoxy, ethoxy, n-propoxy, and isopropoxy; and aryl groups such as phenyl, naphthyl, anthryl, and pyrenyl. More preferred examples include the alkyl groups or the alkoxy groups. Especially preferred examples include methyl and ethyl.

Examples of the copolyamide resin containing constituent units of the diamine represented by general formula (1) include polymers obtained by copolymerizing two, three, four, or more monomers comprising a combination of that diamine and other monomer(s) selected, for example, from: lactams such as γ-butyrolactam, ϵ-caprolactam, and laurolactam; dicarboxylic acids such as 1,4-butanedicarboxylic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; and piperazine. Monomer proportions in this copolymerization are not particularly limited. However, the proportion of units of the diamine represented by general formula (1) is generally 5-40 mol %, preferably 5-30 mol %.

The number-average molecular weight of the copolyamide resin is preferably 10,000-50,000, especially preferably 15,000-35,000. Too low number-average molecular weights and too high number-average molecular weights each tend to result in difficulties in maintaining film evenness. Processes for producing the copolyamide are not particularly limited, and an ordinary polycondensation method for polyamide resin production may be suitably used. Examples thereof include the melt polymerization method, solution polymerization method, and interfacial polymerization method. A monobasic acid such as acetic acid or benzoic acid or a monoacidic base such as hexylamine or aniline may be added as a molecular weight regulator in the polymerization; this does not pose any problem. It is also possible to add a heat stabilizer represented by sodium phosphite, sodium hypophosphite, phosphorous acid, hypophosphorous acid, or a hindered phenol and other polymerization additives may be added in the polymerization.

Specific examples of the copolyamide resin use of which in the undercoat layer is preferred are shown below. In each of the following examples, the copolymerization proportions mean the proportions (molar proportions) of the monomers fed.

[Ka-6]

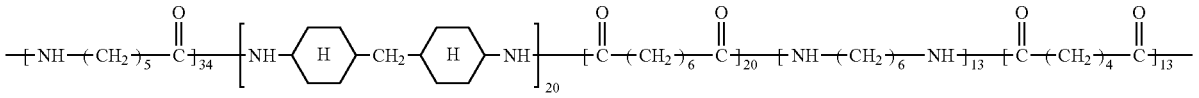

(1)

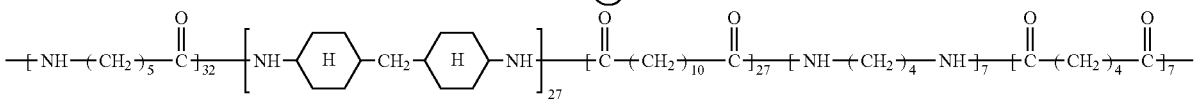

(2)

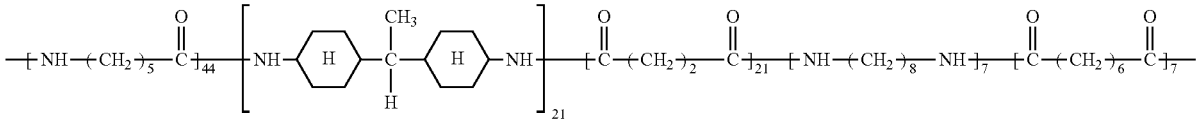

(3)

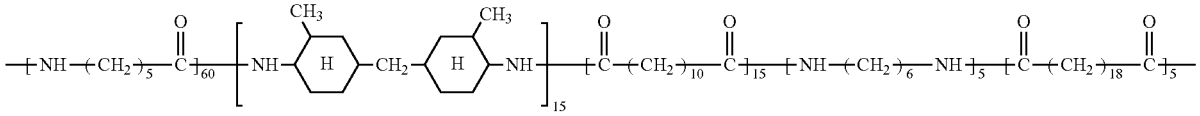

(4)

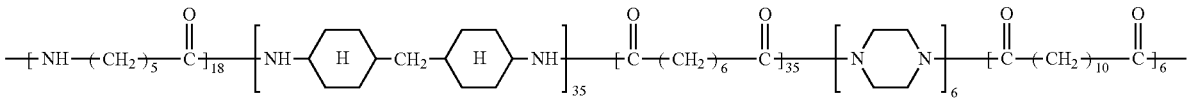

(5)

-continued

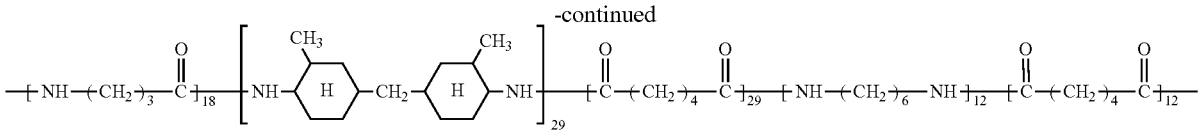

6

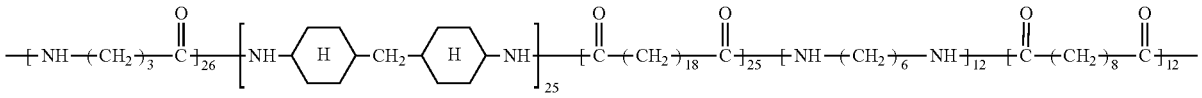

7

The proportion of the metal oxide particles to the binder resin for use in the undercoat layer can be selected at will. However, it is generally preferred to use the metal oxide particles in an amount in the range of from 10 parts by weight to 500 parts by weight per 100 parts by weight of the binder resin from the standpoints of coating-fluid stability and applicability.

The thickness of the undercoat layer can be selected at will. However, from the standpoint of improving the electrical properties, suitability for exposure to intense light, image characteristics, and cycling characteristics of the electrophotographic photoreceptor and applicability in production, it is desirable that the thickness thereof should be generally 0.01 μm or larger, preferably 0.1 μm or larger, and be generally 30 μm or smaller, preferably 20 μm or smaller.

Pigment particles, resin particles, or the like may be incorporated into the undercoat layer for the purpose of, e.g., preventing the generation of image defects.

The coating fluid to be used for forming the undercoat layer preferably is one which contains metal oxide particles which have a volume-average diameter Mv as determined by the dynamic light scattering method of 0.1 μm or smaller and in which the ratio of the volume-average diameter Mv to the number-average diameter Mp, i.e., Mv/Mp, satisfies $1.10 \leq Mv/Mp \leq 1.40$.

More preferred is one in which Mv/Mp satisfies the following relationship.

$$1.20 \leq Mv/Mp \leq 1.35 \quad \text{[Su-1]}$$

The volume-average particle diameter Mv and number-average particle diameter Mp of the metal oxide particles are herein defined as values obtained through a direct examination of the particles in the coating fluid for undercoat layer formation by the dynamic light scattering method, regardless of the state in which the particles are present.

In the dynamic light scattering method, the speed of the Brownian movement of finely dispersed particles is determined by irradiating the particles with a laser light and detecting the scattering of lights differing in phase according to the speed (Doppler shift) to determine a particle size distribution. The values of volume particle diameter of the metal oxide particles in the coating fluid for undercoat layer formation mean values for the particles which are in the state of being stably dispersed in the coating fluid, and mean neither particle diameters of the metal oxide particles in a powder state which have not been dispersed nor particle diameters of a wet cake. An actual examination for determining the volume-average diameter Mv and number-average diameter Mp is made specifically with a particle size distribution analyzer operated by the dynamic light scattering method (MICROTRAC UPA Model 9340-UPA; manufactured by Nikkiso Co., Ltd.; hereinafter abbreviated to UPA) under the following conditions. This particle size distribution analyzer was operated according to the operating manual therefor (issued by Nikkiso Co., Ltd.; Document No. T15-490A00, revision No. E).

Upper limit of measurement: 5.9978 μm
Lower limit of measurement: 0.0035 μm
Number of channels: 44
Examination period: 300 sec
Particle transparency: absorption
Refractive index of particle: N/A (not applied)
Particle shape: non-spherical
Density: 4.20 (g/cm$^3$) (※)
Kind of dispersion medium:
Methanol/1-propanol=7/3
Refractive index of dispersion medium: 1.35

(※) The value is for titanium dioxide particles. For other particles, the values given in the operating manual were used.

In the measurement, the sample was diluted with methanol/1-propanol=7/3 mixed solvent so as to result in a sample concentration index (SIGNAL LEVEL) of 0.6-0.8 and examined at 25° C.

The volume-average diameter Mv and the number-average diameter Mp are values calculated with the following equation (A) and equation (B), respectively, from the results concerning a particle size distribution of the particles obtained through the measurement. In the following equations, n represents the number of particles, v represents particle volume, and d represents particle diameter.

[Su-2]

$$Mv = \frac{\Sigma(n \cdot v \cdot d)}{\Sigma(n \cdot v)} \quad \text{Equation (A)}$$

[Su-3]

$$Mp = \frac{\Sigma(n \cdot d)}{\Sigma(n)} \quad \text{Equation (B)}$$

Although the coating fluid for undercoat layer formation generally contains metal oxide particles, these metal oxide particles are present in the state of being dispersed in the coating fluid for undercoat layer formation. For dispersing metal oxide particles in the coating fluid, a wet dispersion process may be employed in which the particles are dispersed in an organic solvent with a known mechanical pulverizer such as, e.g., a ball mill, sand grinding mill, planetary mill, or roll mill. Although the coating fluid can be thus produced, it is preferred to use a dispersing medium for dispersing the particles as in the production of the coating fluid for photosensitive-layer formation described above.

For a dispersion process using a dispersing medium, any known dispersing apparatus may be used. Examples thereof include a pebble mill, ball mill, sand mill, screen mill, gap mill, vibrating mill, paint shaker, and attritor. Preferred of these is one in which the metal oxide particles can be dispersed while circulating the coating fluid for undercoat layer formation. Wet type ball mills, e.g., a sand mill, screen mill, and gap mill, are used from the standpoints of dispersing efficiency, fineness of the attainable particle diameter, ease of continuous operation, etc. These mills may be either vertical or horizontal. Such mills can have any desired disk shape such as, e.g., the flat plate type, vertical pin type, or horizontal pin type. It is preferred to use a ball mill of the liquid circulation type. This ball mill of the liquid circulation type is the same as that described above in "Dispersion Method" under "Coating Fluid for Photosensitive-Layer Formation and Process for Producing the Same".

In the case of the coating fluid for undercoat layer formation also, it is preferred to use the same liquid-circulating dispersion method and the same dispersing medium as in the case of the coating fluid for photosensitive-layer formation described above.

Methods for applying ultrasonic vibrations to the coating fluid for undercoat layer formation are not particularly limited. Examples thereof include a method in which an ultrasonic oscillator is directly immersed in a container containing the coating fluid; a method in which an ultrasonic oscillator is brought into contact with the outer wall of a container containing the coating fluid; and a method in which a solution containing the coating fluid is immersed in a liquid which is being vibrated with an ultrasonic oscillator. Preferred of those methods is the method in which a solution containing the coating fluid is immersed in a liquid which is being vibrated with an ultrasonic oscillator. In this case, examples of the liquid to be vibrated with an ultrasonic oscillator include water; alcohols such as methanol; aromatic hydrocarbons such as toluene; and fats and oils such as silicone oils. However, it is preferred to use water when safety in production, cost, cleanability, etc. are taken into account. In the method in which a solution containing the coating fluid is immersed in a liquid which is being vibrated with an ultrasonic oscillator, the efficiency of ultrasonic treatment varies with the temperature of the liquid. It is therefore preferred to keep the temperature of the liquid constant. There are cases where the temperature of the liquid being vibrated increases due to the ultrasonic vibrations applied. The temperature of the liquid in conducting the ultrasonic treatment preferably is in the range of generally 5-60° C., preferably 10-50° C., more preferably 15-40° C.

The container for containing the coating fluid for undercoat layer formation in conducting the ultrasonic treatment may be any container as long as it is in common use for containing a coating fluid for forming the undercoat layer of an electrophotographic photoreceptor. Examples thereof include containers made of a resin such as polyethylene or polypropylene, containers made of a glass, and metallic cans. Preferred of these are metallic cans. Especially preferred is an 18-L metallic can as provided for in JIS Z 1602. This is because the metallic can is less apt to be attacked by organic solvents and has high impact strength.

According to need, the coating fluid for undercoat layer formation is used after having been filtered in order to remove coarse particles. In this case, the filtering medium to be used may be any of filtering materials in common use for filtration, such as cellulose fibers, resin fibers, and glass fibers. With respect to the form of the filtering medium, it preferably is a so-called wound filter comprising a core material and fibers of any of various kinds wound around the core material, for example, because this filter has a large filtration area to attain a satisfactory efficiency. The core material to be used can be any of known core materials. However, examples thereof include stainless-steel core materials and core materials made of a resin which does not dissolve in the coating fluid for undercoat layer formation, such as, e.g., polypropylene.

The coating fluid for undercoat layer formation thus produced is used for forming an undercoat layer optionally after a binder, various aids, etc. are further added thereto.

The undercoat layer is formed by applying the coating fluid for undercoat layer formation on a support by a known coating technique, such as, e.g., dip coating, spray coating, nozzle coating, spiral coating, ring coating, bar coating, roll coating, or blade coating, and drying the coating fluid applied.

Examples of the spray coating include air spraying, airless spraying, electrostatic air spraying, electrostatic airless spraying, rotary atomization type electrostatic spraying, hot spraying, and hot airless spraying. However, when the degree of reduction into fine particles, which is necessary for obtaining an even film thickness, efficiency of adhesion, etc. are taken into account, it is preferred to use rotary atomization type electrostatic spraying in which the conveyance method disclosed in Domestic Re-publication of PCT Patent Application No. 1-805198, i.e., a method in which cylindrical works are successively conveyed while rotating these without spacing these in the axial direction, is used. Thus, an electrophotographic photoreceptor having excellent evenness in film thickness can be obtained while attaining a comprehensively high degree of adhesion.

Examples of the spiral coating include the method employing a cast coater or curtain coater disclosed in JP-A-52-119651, the method in which a coating material is continuously ejected in a streak form through a minute opening as disclosed in JP-A-1-231966, and the method employing a multinozzle structure as disclosed in JP-A-3-193161.

In the case of dip coating, the coating fluid for undercoat layer formation usually has a total solid concentration which is generally 1% by weight or higher, preferably 10% by weight or higher, and is generally 50% by weight or lower, preferably 35% by weight or lower. The viscosity thereof is regulated to a value which is preferably 0.1 mPa·s or higher and is preferably 100 mPa·s or lower.

After the application, the coating film is dried. The drying temperature and time are regulated so that necessary and sufficient drying is conducted. The drying temperature is in the range of generally 100-250° C., preferably from 110° C. to 170° C., more preferably from 115° C. to 140° C. For the drying, use can be made of a hot-air drying oven, steam dryer, infrared dryer, and far-infrared dryer.

<Photosensitive Layer>

The photosensitive layer is formed by applying the coating fluid for photosensitive-layer formation of the invention to the conductive support described above (or on the undercoat layer described above when this layer has been formed) and drying the coating fluid applied. Examples of the type of the photosensitive layer include the single-layer structure in which a charge-generating material and a charge-transporting material are present in the same layer and are dispersed in a binder resin (single-layer type photosensitive layer) and the lamination structure composed of two or more layers comprising a charge-generating layer comprising a binder resin and a charge-generating material dispersed therein and a charge-transporting layer comprising a binder resin and a charge-transporting material dispersed therein (lamination type photosensitive layer). The type of the photosensitive layer may be either of these. Since the coating fluid for photosensitive-layer formation of the invention is one containing a charge-generating material, the coating fluid for use in forming a single-layer type photosensitive layer is prepared so as to further contain a charge-transporting material and this coating fluid is used for forming the photosensitive layer. In the case of a lamination type photosensitive layer, the coating fluid for photosensitive-layer formation of the invention is used for forming a charge-transporting layer.

Examples of the lamination type photosensitive layer include: a normal lamination type photosensitive layer comprising a charge-generating layer and a charge-transporting layer which have been superposed in this order from the conductive-support side; and a reverse lamination type photosensitive layer comprising a charge-transporting layer and a charge-generating layer which have been superposed in this order from the support side. Any type may be employed.

<Layer Containing Charge-Generating Material>

(Multilayer Type Photosensitive Layer)

In the case where the photosensitive layer is the so-called lamination type photosensitive layer, the layer containing a charge-generating material generally is the charge-generating layer. However, a charge-generating material may be contained in the charge-transporting layer. In the case where the layer containing a charge-generating material is the charge-generating layer, the amount of the charge-generating material incorporated is generally in the range of 30-500 parts by weight, more preferably in the range of from 50-300 parts by weight, per 100 parts by weight of the binder resin contained in the charge-generating layer. In case where the amount of the charge-generating material incorporated relative to the binder resin amount is too small, this results in an electrophotographic photoreceptor having insufficient electrical properties. In case where the amount thereof is too small, the coating fluid has impaired stability. In the layer containing a charge-generating material, the volume-average particle diameter of the charge-generating material is preferably 1 μm or smaller, more preferably 0.5 μm or smaller. The thickness of the charge-generating layer is generally 0.1 μm to 2 μm, preferably 0.15 μm to 0.8 μm. The charge-generating layer may contain additives such as, e.g., a known plasticizer for improving film-forming properties, flexibility, mechanical strength, etc., an additive for residual-potential diminution, a dispersing agent for improving dispersion stability, and a leveling agent, surfactant, silicone oil, or fluorochemical oil for improving applicability.

(Single-Layer Type Photosensitive Layer)

In the case where the photosensitive layer is the so-called single-layer type photosensitive layer, the charge-generating material described above under the section "Coating Fluid for Photosensitive-Layer Formation" is dispersed in a matrix comprising a binder resin and a charge-transporting material as main components in the same proportion as in the charge-transporting layer which will be described later. In this case, the particle diameter and amount of the charge-generating material incorporated are the same as those explained in that section. In this single-layer type photosensitive layer, the matrix serves as both a charge-generating layer and a charge-transporting layer. Consequently, the coating fluid for forming the matrix is within the range of the coating fluid for photosensitive-layer formation of the invention.

With respect to the amount of the charge-generating material to be dispersed in this photosensitive layer, too small amounts do not give sufficient sensitivity and too large amounts exert an adverse influence to cause a decrease in electrification characteristics, decrease insensitivity, etc. Because of this, the charge-generating material is used, for example, in an amount preferably in the range of 0.5-50% by weight, more preferably in the range of 10-45% by weight. The thickness of this photosensitive layer is generally 5-50 μm, more preferably 10-45 μm. The single-layer type photosensitive layer also may contain additives such as, e.g., a known plasticizer for improving film-forming properties, flexibility, mechanical strength, etc., an additive for residual-potential diminution, a dispersing agent for improving dispersion stability, and a leveling agent, surfactant, silicone oil, or fluorochemical oil for improving applicability.

<Layer Containing Charge-Transporting Material>

In the case of the so-called lamination type photosensitive layer, the charge-transporting layer may be constituted only of a resin having the function of transporting charges. However, a constitution in which any of the charge-transporting materials shown below is dispersed or dissolved in a binder resin is more preferred. On the other hand, in the case of the so-called single-layer type photosensitive layer, a constitution is employed in which a charge-generating material is dispersed in a matrix comprising a binder resin and any of the following charge-transporting materials dispersed or dissolved in the resin.

Examples of the charge-transporting material include polymeric compounds such as polyvinylcarbazole, polyvinylpyrene, polyglycidylcarbazole, and polyacenaphthylene; polycyclic aromatic compounds such as pyrene and anthracene; heterocyclic compounds such as indole derivatives, imidazole derivatives, carbazole derivatives, pyrazole derivatives, pyrazoline derivatives, oxadiazole derivatives, oxazole derivatives, and thiazole derivatives; hydrazone compounds such as p-diethylaminobenzaldehyde N,N-diphenylhydrazone and N-methylcarbazole-3-carbaldehyde N,N-diphenylhydrazone; styryl compounds such as 5-(4-(di-p-tolylamino)benzylidene)-5H-dibenzo(a,d)cyclohept ene; triarylamine compounds such as p-tritolylamine; benzidine compounds such as N,N,N',N'-tetraphenylbenzidine; butadiene compounds; and triphenylmethane compounds such as di(p-ditolylaminophenyl)methane. Preferred of these are hydrazone derivatives, carbazole derivatives, styryl compounds, butadiene compounds, triarylamine compounds, benzidine compounds, or compounds each made up of two or more of these compounds bonded to each other. Those charge-transporting materials may be used alone or as a mixture of some of these.

Examples of the binder resin for use in the layer containing a charge-transporting material include vinyl polymers such as poly(methyl methacrylate), polystyrene, and poly(vinyl chloride), copolymers of these, polycarbonates, polyarylates, polyesters, polyester carbonates, polysulfones, polyimides, phenoxies, epoxies, and silicone resins. Cured resins obtained by partly crosslinking these resins are also usable.

The layer containing a charge-transporting material may contain various additives according to need, such as an antioxidant, e.g., a hindered phenol or hindered amine, ultraviolet absorber, sensitizer, leveling agent, and electron-attracting substance. The thickness of the layer containing a charge-transporting material is generally 5-60 μm, preferably 10-45 μm, more preferably 15-27 μm.

The binder resin and a charge-transporting material are used in such a proportion that the amount of the charge-transporting material is generally 20-200 parts by weight, preferably in the range of 30-150 parts by weight, more preferably in the range of 40-120 parts by weight, per 100 parts by weight of the binder resin.

<Surface Layer>

A known surface-protective layer or overcoat layer consisting mainly of a thermoplastic or thermoset polymer may be formed as an outermost layer.

<Method of Forming the Layers>

The layers for constituting the electrophotographic photoreceptor are formed by successively applying coating fluids each obtained by dissolving or dispersing substances to be incorporated into the layer in a solvent, as in the case of the coating fluid for photosensitive-layer formation of the invention, by a known technique such as, for example, dip coating, spray coating, or ring coating. In this case, the coating fluids may contain various additives according to need, such as a leveling agent for improving applicability, antioxidant, and sensitizer.

For producing the coating fluids, the organic solvents usable in the wet mechanical dispersion process described above can be employed. Preferred examples thereof include alcohols such as methanol, ethanol, propanol, cyclohexanone, 1-hexanol, and 1,3-butanediol; ketones such as acetone, methyl ethyl ketone, methyl isobutyl ketone, and cyclohexanone; ethers such as dioxane, tetrahydrofuran, and ethylene glycol monomethyl ether; ether ketones such as 4-methoxy-4-methyl-2-pentanone; (halogenated) aromatic hydrocarbons such as benzene, toluene, xylene, and chlorobenzene; esters such as methyl acetate and ethyl acetate; amides such as N,N-dimethylformamide and N,N-dimethylacetamide; and sulfoxides such as dimethyl sulfoxide. Especially preferred of these solvents are alcohols, aromatic hydrocarbons, and ether ketones. More preferred examples include toluene, xylene, 1-hexanol, 1,3-butanediol, and 4-methoxy-4-methyl-2-pentanone.

Although at least one of those solvents is used, a mixture of two or more of those solvents may be used. Solvents suitable for mixing are ethers, alcohols, amides, sulfoxides, ether ketones, amides, sulfoxides, and ether ketones. Of these, ethers such as 1,2-dimethoxyethane and alcohols such as 1-propanol are suitable. Especially preferably, ethers are mixed. This is suitable especially for the production of a coating fluid using oxytitanium phthalocyanine as a charge-generating material, from the standpoints of the ability to stabilize the crystal form of the phthalocyanine pigment, dispersion stability, etc.

[Image-Forming Apparatus]

Embodiments of the image-forming apparatus employing the electrophotographic photoreceptor of the invention are explained next by reference to FIG. 2, which illustrates the constitution of important parts of the apparatus. However, embodiments thereof should not be construed as being limited to the following explanations, and any desired modifications can be made unless they depart from the spirit of the invention.

Figure 2:
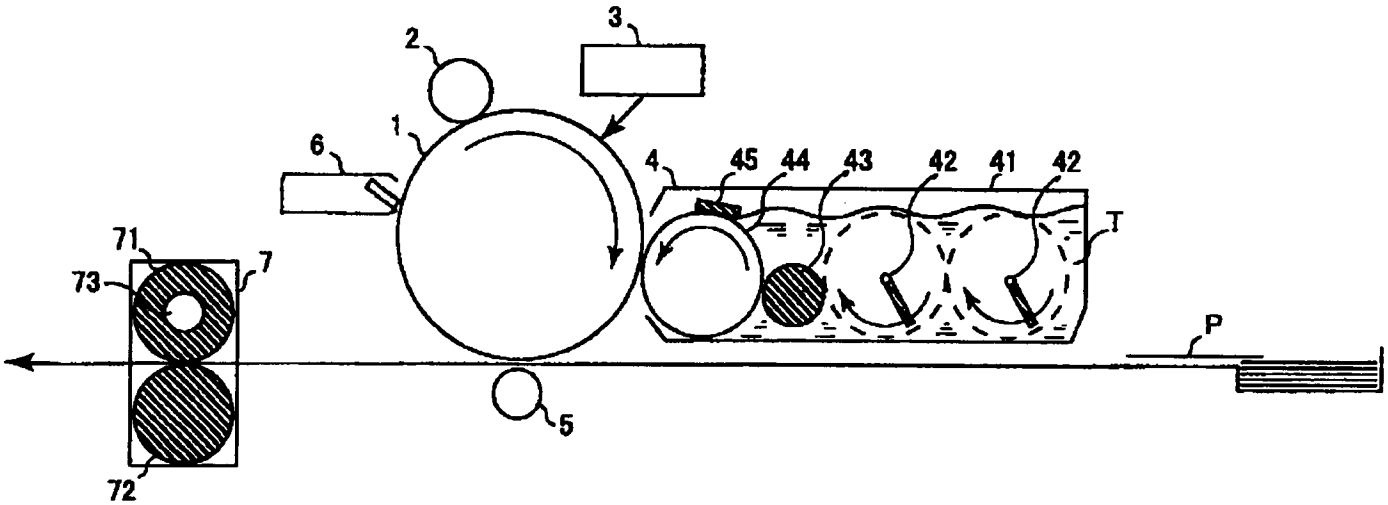
FIG. 2 is a diagrammatic view illustrating the constitution of important parts of one embodiment of the image-forming apparatus equipped with the electrophotographic photoreceptor of the invention.

As shown in FIG. 2, this image-forming apparatus comprises an electrophotographic photoreceptor 1, a charging device 2, an exposure device 3, a development device 4, and a transfer device 5. A cleaning device 6 and a fixing device 7 are further disposed according to need.

In case where the electrophotographic photoreceptor of the invention is not employed, exposure-charging cycle characteristics in a low-temperature low-humidity environment are not stable and the images obtained frequently have image defects such as black spots or color spots. This image-forming apparatus cannot stably form clear images. The nonuse of the electrophotographic photoreceptor of the invention is hence undesirable.

The electrophotographic photoreceptor 1 is not particularly limited as long as it is the electrophotographic photoreceptor of the invention described above. FIG. 2 shows one example thereof, which is a drum-form photoreceptor comprising a cylindrical conductive support and the photosensitive layer described above which has been formed on the surface of the support. The charging device 2, exposure device 3, development device 4, transfer device 5, and cleaning device 6 have been disposed along the peripheral surface of the electrophotographic photoreceptor 1.

The charging device 2 charges the electrophotographic photoreceptor 1. It evenly charges the surface of the electrophotographic photoreceptor 1 to a given potential. FIG. 2 shows a roller type charging device (charging roller) as an example of the charging device 2. Other charging devices in frequent use include corona-charging devices such as corotrons and scorotrons and contact type charging devices such as charging brushes.

In many cases, the electrophotographic photoreceptor 1 and the charging device 2 are designed as a cartridge including both (hereinafter referred to as photoreceptor cartridge) so that the cartridge can be demounted from the image-forming apparatus main body. In the invention also, the photoreceptor 1 and the charging device 2 are desirably used in that form. Furthermore, a constitution in which the charging device is disposed in contact with the electrophotographic photoreceptor is desirable in the invention because the effects of the invention are remarkably produced in this case as described above.

In this constitution, when, for example, the electrophotographic photoreceptor 1 or the charging device 2 has deteriorated, this photoreceptor cartridge can be demounted from the image-forming apparatus main body and a fresh photoreceptor cartridge can be mounted in the image-forming apparatus main body. With respect to a toner also, which will be described later, it in many cases is designed to be stored in a toner cartridge and be capable of being demounted from the image-forming apparatus main body. When the toner cartridge which is being used has run out of the toner, this toner cartridge can be demounted from the image-forming apparatus main body and a fresh toner cartridge can be mounted. There also are cases where a cartridge including all of the electrophotographic photoreceptor 1, charging device 2, and toner is used.

The kind of the exposure device 3 is not particularly limited as long as it can illuminate the electrophotographic photoreceptor 1 to form an electrostatic latent image on the photosensitive surface. Examples thereof include halogen lamps, fluorescent lamps, lasers such as semiconductor lasers and He—Ne lasers, and LEDs. The technique of internal photoreceptor exposure may be used to conduct exposure. Any desired light may be used for exposure. For example, the photoreceptor 1 may be exposed to the monochromatic light having a wavelength of 780 nm, a monochromatic light having a slightly short wavelength of 600 nm to 700 nm, or a monochromatic light having a short wavelength of 350 nm to 600 nm. Of these, a monochromatic light having a short wavelength of 350 nm to 600 nm is preferred for the exposure. More preferred is to expose the photoreceptor 1 to a monochromatic light having a wavelength of 380 nm to 500 nm.

The kind of the development device 4 is not particularly limited, and any desired device can be used, such as, e.g., one of the dry development type employing cascade development, development with a one-component conductive toner, or magnetic-brush development with two components or one of the wet development type. The development device 4 in FIG. 2 comprises a developing vessel 41, agitators 42, a feed roller 43, a developing roller 44, and a control member 45. It has a constitution in which a toner T is stored in the developing vessel 41. According to need, a replenisher (not shown) for replenishing the toner T may be attached to the development device 4. This replenisher is constituted so that the toner T can be replenished from a container such as a bottle or cartridge.

The feed roller 43 is constituted, for example, of a conductive sponge. The developing roller 44 comprises, for example, a metallic roll made of iron, stainless steel, aluminum, or nickel or a resin roll obtained by coating such a metallic roll with a silicone resin, urethane resin, fluororesin, or the like. The surface of this developing roller 44 may be subjected to smoothing processing or roughening processing according to need.

The developing roller 44 has been disposed between the electrophotographic photoreceptor 1 and the feed roller 43 and is in contact with each of the electrophotographic photoreceptor 1 and the feed roller 43. The feed roller 43 and the developing roller 44 are rotated by a rotating/driving mechanism (not shown). The feed roller 43 holds the toner T stored and feeds it to the developing roller 44. The developing roller 44 holds the toner T fed by the feed roller 43 and brings it into contact with the surface of the electrophotographic photoreceptor 1.

The control member 45 is constituted, for example, of a resin blade made of a silicone resin, urethane resin, or the like, a metallic blade made of stainless steel, aluminum, copper, brass, phosphor bronze, or the like, or a blade obtained by coating such as a metallic blade with a resin. This control member 45 is in contact with the developing roller 44 and is being pressed against the developing roller 44 at a given force (linear blade pressure is generally 5-500 g/cm) with a spring or the like. According to need, the function of charging the toner T based on friction with the toner T may be imparted to the control member 45.

The agitators 42 are rotated by the rotating/driving mechanism. They agitate the toner T and send the toner T to the feed roller 43 side. The agitators 42 may be ones differing in blade shape, size, etc.

The kind of the toner T is not limited. Besides a powdery toner, usable toners include a polymerization toner produced by the suspension polymerization method, emulsion polymerization method, etc. Especially when a polymerization toner is to be employed, one having a small particle diameter of about 4-8 μm is preferred, and ones having various toner particle shapes ranging from a nearby spherical shape to a non-spherical potato shape can be used. Polymerization toners are excellent in electrification evenness and transferability and are suitable for use in attaining high image quality.

The kind of the transfer device 5 is not particularly limited, and use can be made of a device of any desired type working by the electrostatic transfer method, pressure transfer method, adhesion transfer method, or the like, such as corona transfer, roller transfer, or belt transfer. In this embodiment, the transfer device 5 is constituted of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus transfers a toner image formed on the electrophotographic photoreceptor 1 to a receiving material (paper or medium) P. In the invention, the apparatus is effective when the transfer device 5 is disposed so as to be in contact with the photoreceptor through a receiving material.

The cleaning device 6 is not particularly limited, and any desired cleaning device can be employed, such as, e.g., a brush cleaner, magnetic brush cleaner, electrostatic brush cleaner, magnetic roller cleaner, or blade cleaner. The cleaning device 6 serves to scrape off the residual toner adherent to the photoreceptor 1 with a cleaning member and recover the residual toner. However, in the case where the amount of the toner remaining on the photoreceptor surface is small or almost nil, the cleaning device 6 may be omitted.

The fixing device 7 is constituted of an upper fixing member (pressure roller) 71 and a lower fixing member (fixing roller) 72. The fixing member 71 or 72 is equipped with a heater 73 inside. In the example shown in FIG. 2, the upper fixing member 71 is equipped with a heater 73 inside. The upper and lower fixing members 71 and 72 each can be a known heat-fixing member such as, e.g., a fixing roll obtained by coating a metallic pipe made of, e.g., stainless steel or aluminum with a silicone rubber, a fixing roll obtained by further coating the rubber-coated pipe with a fluororesin, or a fixing sheet. The fixing members 71 and 72 may have a constitution in which a release agent, e.g., a silicone oil, is supplied thereto in order to improve release properties, or may have a constitution in which the two members are forcedly pressed against each other with a spring or the like.

The toner transferred to the recording paper P passes through the nip between the upper fixing member 71 heated at a given temperature and the lower fixing member 72, during which the toner is heated to a molten state. After the passing, the toner is cooled and fixed to the recording paper P.

The kind of the fixing device also is not particularly limited. Besides the fixing device used here, a fixing device of any desired type can be employed, such as one for hot-roller fixing, flash fixing, oven fixing, or pressure fixing.

In the image-forming apparatus having the constitution described above, an image is recorded in the following manner. First, the surface (photosensitive surface) of the photoreceptor 1 is charged to a given potential (e.g., −600 V) by the charging device 2. This charging may be accomplished with a direct-current voltage or with a direct-current voltage on which an alternating-current voltage has been superimposed.

Subsequently, the charged photosensitive surface of the photoreceptor 1 is exposed by the exposure device 3 according to the image to be recorded. Thus, an electrostatic latent image is formed on the photosensitive surface. This electrostatic latent image formed on the photosensitive surface of the photoreceptor 1 is developed by the developing device 4.

In the developing device 4, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the photoreceptor 1). This toner T is conveyed while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This tone image is transferred to a recording paper P by the transfer device 5. Thereafter, the toner which has not been transferred and remains on the photosensitive surface of the photoreceptor 1 is removed by the cleaning device 6.

After the transfer of the toner image to the recording paper P, this recording paper P is passed through the fixing device 7 to thermally fix the toner image to the recording paper P. Thus, a finished image is obtained.

Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser may be used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a full-color tandem constitution employing two or more toners.

In the embodiment described above, the electrophotographic photoreceptor cartridge of the invention was explained as a photoreceptor cartridge comprising the electrophotographic photoreceptor 1 and the charging device 2. However, the electrophotographic photoreceptor cartridge of the invention may have any constitution as long as it comprises the electrophotographic photoreceptor 1 and at least one of the charging device (charging part) 2, exposure device (exposure part) 3, and development device (development part) 4. For example, the electrophotographic photoreceptor cartridge of the invention may have a constitution which comprises all of the electrophotographic photoreceptor 1, charging device (charging part) 2, exposure device (exposure part) 3, and development device (development part) 4.

EXAMPLES

The invention will be explained below in more detail by reference to Examples according to the invention and Comparative Examples. However, the invention should not be construed as being limited to the following Examples unless it departs from the spirit of the invention. Each "parts" used in the Examples indicates "parts by weight" unless otherwise indicated.

Reference Example 1

Ten parts of poly(vinyl butyral) (trade name "Denka Butyral" #6000C; manufactured by Denki Kagaku Kogyo K.K.) was dissolved in a mixed solvent composed of 1,2-dimethoxyethane/4-methoxy-4-methyl-2-pentanone=9/1 to produce a polymer solution. Thereafter, 20 parts of D-form oxytitanium phthalocyanine (according to the Production Example 1 given in Japanese Patent Application No. 2004-291274) was suspended in a mixed solvent composed of 1,2-dimethoxyethane/4-methoxy-4-methyl-2-pentanone=9/1, and the resultant liquid was added to the polymer solution produced beforehand to thereby produce a solution having a solid concentration of 3.8 wt %. This solution was subjected to a dispersing treatment with Ultra Apex Mill having a mill capacity of about 0.15 L (Type UAM-015; hereinafter often abbreviated to UAM), manufactured by Kotobuki Industries Co., Ltd., for 20 minutes using zirconia beads having a diameter of about 30 μm (trade name, YTZ; manufactured by Nikkato Corp.) as a dispersing medium under the conditions of a rotor peripheral speed of 8 m/sec and a liquid flow rate of 10 kg/hr while circulating a cooling liquid of 5-12° C. Subsequently, the resultant dispersion was subjected to a 150-minute US treatment. Thus, a coating fluid for charge-generating-layer formation SE1 was produced.

This coating fluid for charge-generating-layer formation SE1 was examined for a viscosity change through 120-day storage at room temperature after the production (value obtained by dividing the difference between the viscosity as measured after 120-day storage and the viscosity as measured just after production by the viscosity as measured just after production). The coating fluid SE1 was further examined for the particle size distribution and dispersion index of the phthalocyanine pigment just after the production.

The viscosities were measured with an E-type viscometer (trade name, ED; manufactured by Tokimec Inc.) by the method in accordance with JIS Z 8803. The particle size distribution was determined with the UPA. The dispersion index was determined by diluting the coating fluid to such a degree as to result in an absorbance at 775 nm of 1 and dividing the absorbance as measured at 775 nm by the absorbance as measured at 1,000 nm; the resultant quotient was taken as the dispersion index. The results obtained are shown in Table 1.

Example 1

The same procedure for coating fluid production as in Reference Example 1 was conducted, except that the dispersing treatment of D-form oxytitanium phthalocyanine (according to the Production Example 1 given in Japanese Patent Application No. 2004-291274) with Ultra Apex Mill was conducted for 40 minutes. Thus, a coating fluid for charge-generating-layer formation SE2 was produced. Furthermore, the coating fluid was examined for viscosity change, particle size distribution, and dispersion index in the same manners as in Reference Example 1. The results obtained are shown in Table 1.

Example 2

The same procedure for coating fluid production as in Reference Example 1 was conducted, except that the dispersing treatment of D-form oxytitanium phthalocyanine (according to the Production Example 1 given in Japanese Patent Application No. 2004-291274) with Ultra Apex Mill was conducted for 60 minutes. Thus, a coating fluid for charge-generating-layer formation SE3 was produced. Furthermore, the coating fluid was examined for viscosity change, particle size distribution, and dispersion index in the same manners as in Reference Example 1. The results obtained are shown in Table 1.

Comparative Example 1

Twenty parts of D-form oxytitanium phthalocyanine (according to the Production Example 1 given in Japanese Patent Application No. 2004-291274) was mixed with 375 parts of 1,2-dimethoxyethane. This mixture was subjected to a dispersing treatment with a sand grinding mill (hereinafter often abbreviated to SGM) for 20 minutes (dispersing medium: trade name, GB200M; manufactured by Potters-Ballotini Co., Ltd.). Subsequently, the liquid treated was diluted with 120 parts of 1,2-dimethoxyethane, and the resultant dilution was dropped into a binder solution obtained by dissolving 10 parts of poly(vinyl butyral) (trade name "Denka Butyral" #6000C; manufactured by Denki Kagaku Kogyo K.K.) in a liquid mixture of 135 parts of 1,2-dimethoxyethane and 76 parts of 4-methoxy-4-methyl-2-pentanone. Thereafter, a US treatment was conducted for 150 minutes to prepare a coating fluid for charge-generating-layer formation SP1. Furthermore, the coating fluid was examined for viscosity change, particle size distribution, and dispersion index in the same manners as in Reference Example 1. The results obtained are shown in Table 1.

Comparative Example 2

The same procedure for coating fluid production as in Comparative Example 1 was conducted, except that the dispersing treatment of D-form oxytitanium phthalocyanine (according to the Production Example 1 given in Japanese Patent Application No. 2004-291274) with the sand grinding mill was conducted for 40 minutes. Thus, a coating fluid for charge-generating-layer formation SP2 was produced. Furthermore, the coating fluid was examined for viscosity change, particle size distribution, and dispersion index in the same manners as in Reference Example 1. The results obtained are shown in Table 1.

Comparative Example 3

The same procedure for coating fluid production as in Comparative Example 1 was conducted, except that the dispersing treatment of D-form oxytitanium phthalocyanine (according to the Production Example 1 given in Japanese Patent Application No. 2004-291274) with the sand grinding mill was conducted for 60 minutes. Thus, a coating fluid for charge-generating-layer formation SP3 was produced. Furthermore, the coating fluid was examined for viscosity change, particle size distribution, and dispersion index in the same manners as in Reference Example 1. The results obtained are shown in Table 1.

Reference Example 2

Twenty parts of A-form oxytitanium phthalocyanine (according to the production process in an Example given in Japanese Patent Application No. 8-163133) was suspended in a mixed solvent composed of 1,2-dimethoxyethane/4-methoxy-4-methyl-2-pentanone=9/1. The resultant liquid was subjected to a dispersing treatment with Ultra Apex Mill having a mill capacity of about 0.15 L (Type UAM-015), manufactured by Kotobuki Industries Co., Ltd., for 1 hour using zirconia beads having a diameter of about 30 μm (trade name, YTZ; manufactured by Nikkato Corp.) as a dispersing medium under the conditions of a rotor peripheral speed of 8 m/sec and a liquid flow rate of 10 kg/hr while circulating a cooling liquid of 5-12° C. This dispersion was added to a polymer solution prepared by dissolving 10 parts of poly (vinyl butyral) (trade name "Denka Butyral" #6000C; manufactured by Denki Kagaku Kogyo K.K.) in a mixed solvent composed of 1,2-dimethoxyethane/4-methoxy-4-methyl-2-pentanone=9/1. The resulatnt mixture (final solid concentration, 3.8%) was subjected to a 150-minute US treatment. Thus, a coating fluid for charge-generating-layer formation SE4 was produced. Furthermore, the coating fluid was examined for viscosity change, particle size distribution, and dispersion index in the same manners as in Reference Example 1. The results obtained are shown in Table 1.

Example 3

The same procedure for coating fluid production as in Reference Example 2 was conducted, except that the dispersing treatment with Ultra Apex Mill was conducted for 2.5 hours. Thus, a coating fluid for charge-generating-layer formation SE5 was produced. Furthermore, the coating fluid was examined for viscosity change, particle size distribution, and dispersion index in the same manners as in Reference Example 1. The results obtained are shown in Table 1.

Comparative Example 4

The same procedure for coating fluid production as in Comparative Example 1 was conducted, except that A-form oxytitanium phthalocyanine (according to the production process in an Example given in Japanese Patent Application No. 8-163133) was used in place of the D-form oxytitanium phthalocyanine and that the dispersing treatment with the sand grinding mill (SGM) was conducted for 1 hour. Thus, a coating fluid for charge-generating-layer formation SP4 was produced. Furthermore, the coating fluid was examined for viscosity change, particle size distribution, and dispersion index in the same manners as in Reference Example 1. The results obtained are shown in Table 1.

Comparative Example 5

The same procedure for coating fluid production as in Comparative Example 1 was conducted, except that A-form oxytitanium phthalocyanine (according to the production process in an Example given in Japanese Patent Application No. 8-163133) was used in place of the D-form oxytitanium phthalocyanine and that the dispersing treatment with the sand grinding mill (SGM) was conducted for 2.5 hours. Thus, a coating fluid SP5 was produced. Furthermore, the coating fluid was examined for viscosity change, particle size distribution, and dispersion index in the same manners as in Reference Example 1. The results obtained are shown in Table 1.

Example 6

The same procedure for coating fluid production as in Reference Example 1 was conducted, except that A-form oxytitanium phthalocyanine (according to the production process in an Example given in Japanese Patent Application No. 8-163133) was used in place of the D-form oxytitanium phthalocyanine, that zirconia beads having a diameter of about 100 μm (trade name, YTZ; manufactured by Nikkato Corp.) were used in place of the zirconia beads having a diameter of about 30 μm (trade name, YTZ; manufactured by Nikkato Corp.), and that the dispersing treatment with Ultra Apex Mill was conducted for 1 hour. Thus, a coating fluid for charge-generating-layer formation SE6 was produced. Furthermore, the coating fluid was examined for viscosity change, particle size distribution, and dispersion index in the same manners as in Reference Example 1. The results obtained are shown in Table 1.

Comparative Example 6

The same procedure for coating fluid production as in Comparative Example 1 was conducted, except that A-form oxytitanium phthalocyanine (according to the production process in an Example given in Japanese Patent Application No. 8-163133) was used in place of the D-form oxytitanium phthalocyanine and that zirconia beads having a diameter of about 500 μm were used as a dispersing medium. Thus, a coating fluid for charge-generating-layer formation SP6 was produced. Furthermore, the coating fluid was examined for viscosity change, particle size distribution, and dispersion index in the same manners as in Reference Example 1. The results obtained are shown in Table 1.

Comparative Example 7

With 30 parts of 1,2-dimethoxyethane was mixed 1.5 parts of the charge-generating material represented by the following formula. This mixture was subjected to a dispersing treatment with Ultra Apex Mill having a mill capacity of about 0.15 L (Type UAM-015), manufactured by Kotobuki Industries Co., Ltd., for 3 hours using zirconia beads having a diameter of about 200 μtm (trade name, YTZ; manufactured by Nikkato Corp.) as a dispersing medium under the conditions of a rotor peripheral speed of 8 m/sec and a liquid flow rate of 10 kg/hr while circulating a cooling liquid of 5-12° C.

[Ka-7]

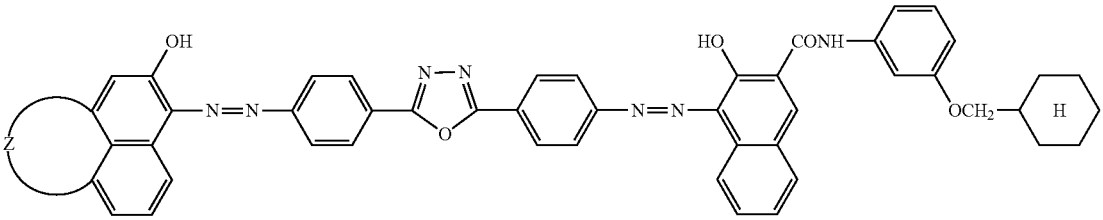

(Z represents mixture of

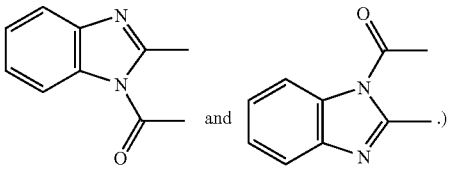

Subsequently, the resultant dispersion was mixed with a binder solution prepared by dissolving 0.75 parts of poly (vinyl butyral) (trade name "Denka Butyral" #6000C; manufactured by Denki Kagaku Kogyo K.K.) and 0.75 parts of a phenoxy resin (PKHH, manufactured by Union Carbide Corp.) in 28.5 parts of 1,2-dimethoxyethane. Finally, 13.5 parts of a liquid mixture of 1,2-dimethoxyethane and 4-methoxy-4-methyl-2-pentanone in any proportion was added thereto to produce a coating fluid for charge-generating-layer formation SE7 having a solid (pigment+resins) concentration of 4.0% by weight.

The dispersion index was determined by diluting the coating fluid to such a degree as to result in an absorbance at 530 nm of 1 and dividing the absorbance as measured at 530 nm by the absorbance as measured at 640 nm; the resultant quotient was taken as the dispersion index. Furthermore, the coating fluid was examined for viscosity change and particle size distribution in the same manners as in Reference Example 1. The results obtained are shown in Table 1.

Comparative Example 8

With 30 parts of 1,2-dimethoxyethane was mixed 1.5 parts of the charge-generating material used in Comparative Example 7. This mixture was subjected to a dispersing treatment with a sand grinding mill for 8 hours (dispersing medium: GB200M). Subsequently, the resultant dispersion was mixed with a binder solution prepared by dissolving 0.75 parts of poly(vinyl butyral) (trade name "Denka Butyral" #6000C; manufactured by Denki Kagaku Kogyo K.K.) and 0.75 parts of a phenoxy resin (PKHH, manufactured by Union Carbide Corp.) in 28.5 parts of 1,2-dimethoxyethane. Finally, 13.5 parts of a liquid mixture of 1,2-dimethoxyethane and 4-methoxy-4-methyl-2-pentanone in any proportion was added thereto to produce a coating fluid for charge-generating-layer formation SP7 having a solid (pigment+resins) concentration of 4.0% by weight. The dispersion index was determined in the same manner as in Comparative Example 7, and the viscosity change and particle size distribution were determined in the same manners as in Reference Example 1. The results obtained are shown in Table 1.

TABLE 1

| | Coating fluid | Medium | Medium diameter (μm) | Dispersing treatment | Dispersing period | Viscosity change | D50 (μm) | D90 (μm) | Dispersion index |
|---|---|---|---|---|---|---|---|---|---|
| Reference Example 1 | SE1 | zirconia | 30 | UAM | 20 min | 4% increase | 0.24 | 0.43 | 4.44 |
| Reference Example 2 | SE2 | zirconia | 30 | UAM | 1 hr | 8% increase | 0.21 | 0.38 | 2.40 |
| Example 1 | SE2 | zirconia | 30 | UAM | 40 min | 3% increase | 0.14 | 0.24 | 2.51 |
| Example 2 | SE3 | zirconia | 30 | UAM | 60 min | 1% increase | 0.10 | 0.17 | 1.41 |
| Example 3 | SE5 | zirconia | 30 | UAM | 2.5 hr | 5% increase | 0.13 | 0.21 | 1.50 |
| Example 4 | SE6 | zirconia | 100 | UAM | 1 hr | 4% increase | 0.14 | 0.23 | 1.70 |
| Comparative Example 1 | SP1 | glass | 500 | SGM | 20 min | 10% increase | 0.50 | 0.94 | 10.2 |
| Comparative Example 2 | SP2 | glass | 500 | SGM | 40 min | 8% increase | 0.21 | 0.38 | 6.10 |
| Comparative Example 3 | SP3 | glass | 500 | SGM | 60 min | 4% increase | 0.17 | 0.25 | 3.04 |
| Comparative Example 4 | SP4 | glass | 500 | SGM | 1 hr | 14% increase | 0.43 | 0.96 | 19.8 |
| Comparative Example 5 | SP5 | glass | 500 | SGM | 2.5 hr | 8% increase | 0.22 | 0.31 | 10.2 |
| Comparative Example 6 | SP6 | zirconia | 500 | SGM | 1 hr | 10% increase | 0.33 | 0.54 | 14.3 |
| Comparative Example 7 | SE7 | zirconia | 200 | UAM | 4 hr | 23% increase | 0.12 | 0.25 | 31.0 |
| Comparative Example 8 | SP7 | glass | 500 | SGM | 8 hr | 52% increase | 0.15 | 0.39 | 40.1 |

Evaluation 1

The coating fluids for charge-generating-layer formation prepared by the production process of the invention have a smaller average particle diameter and a narrower particle diameter distribution than those produced by the existing techniques. Because of this, these coating fluids are highly stable and can form an even charge-generating layer. Even when stored for long, the coating fluids change little in viscosity and are highly stable. Furthermore, compared to the dispersing treatment with the classical sand grinding mill or the like, the process of the invention necessitates a far shorter time period for obtaining the same degree of dispersion. The coating fluids can be considered to be ones produced by a technique having a high efficiency and high productivity.

Example 5

Fifty parts of a surface-treated titanium oxide obtained by mixing rutile-form titanium oxide having an average primary particle diameter of 40 nm ("TTO55N" manufactured by Ishihara Sangyo Kaisha, Ltd.) with 3% by weight methyldimethoxysilane ("TSL8117" manufactured by Toshiba Silicone Co., Ltd.) based on the titanium oxide with a Henschel mixer was mixed with 120 parts of methanol to obtain a raw slurry. One kilogram of the raw slurry was subjected to a dispersing treatment with Ultra Apex Mill having a mill capacity of about 0.15 L (Type UAM-015), manufactured by Kotobuki Industries Co., Ltd., using zirconia beads having a diameter of about 100 μm (YTZ, manufactured by Nikkato Corp.) as a dispersing medium for 1 hour at a rotor peripheral speed of 10 m/sec while circulating the liquid at a flow rate of 10 kg/hr. Thus, a titanium oxide dispersion was produced.

The titanium oxide dispersion was mixed with a methanol/1-propanol/toluene mixed solvent and pellets of a copolyamide formed from ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a molar ratio of 60%/15%/5%/15%/5%, with stirring and heating to dissolve the polyamide pellets. Thereafter, the resultant mixture was subjected to an ultrasonic dispersing treatment for 1 hour with an ultrasonic oscillator having an output of 1,200 W and then filtered through a PTFE membrane filter having a pore diameter of 5 μm (Mitex LC, manufactured by Advantec). Thus, a dispersion for undercoat layer formation A was obtained in which the surface-treated titanium oxide/copolyamide weight ratio was 3/1, the methanol/1-propanol/toluene mixed solvent had a weight ratio of 7/1/2, and the concentration of the solid ingredients in the dispersion A was 18.0% by weight.

[Ka-8]

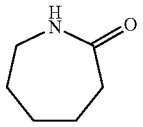

A

-continued

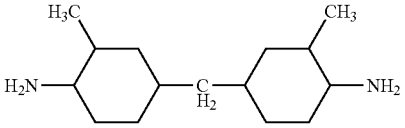

B

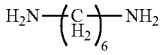

C

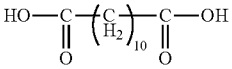

D

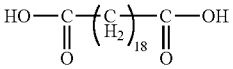

E

The coating fluid for undercoat layer formation A obtained was applied to an aluminum pipe obtained through cutting having an outer diameter of 24 mm, length of 236.5 mm, and wall thickness of 0.75 mm by dip coating in an amount of 2 μm in terms of dry-film thickness. The coating fluid applied was dried to form an undercoat layer.

The dispersion for charge-generating-layer formation was filtered through a PTFE membrane filter having a pore diameter of 5 μm (Mitex LC, manufactured by Advantec) to produce a coating fluid for charge-generating layer formation. This coating fluid for charge-generating layer formation was applied to the undercoat layer by dip coating in an amount of 0.4 μm in terms of dry-film thickness. The coating fluid applied was dried to form a charge-generating layer.

Subsequently, a coating fluid for charge-transporting-layer formation obtained by dissolving 56 parts of the hydrazone compound shown below,

[Ka-9]

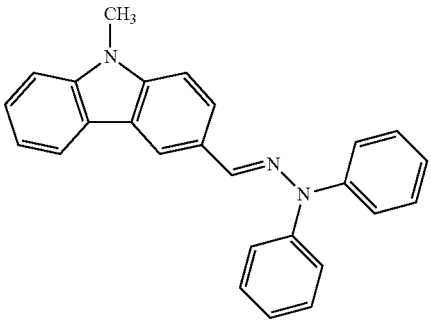

14 parts of the hydrazone compound shown below,

[Ka-10]

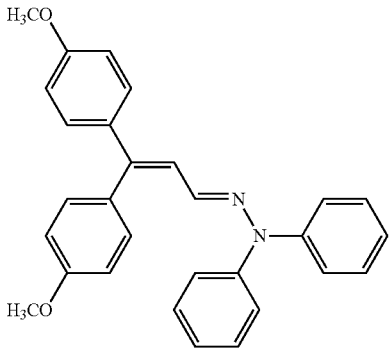

100 parts of a polycarbonate resin having the repeating structures shown below,

[Ka-11]

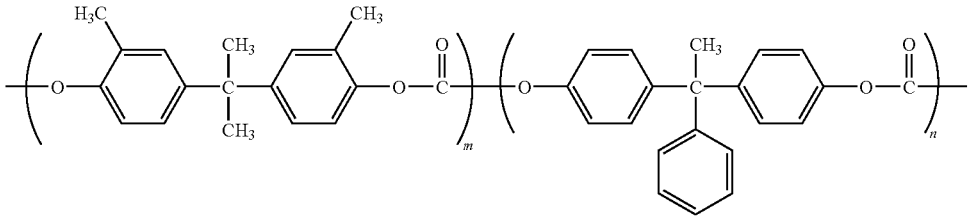

(m:n = 1:1)

and 0.05 parts by weight of a silicone oil in 640 parts by weight of a tetrahydrofuran/toluene (8/2) mixed solvent was applied to the charge-generating layer in an amount of 17 μm in terms of dry-film thickness. The coating fluid applied was air-dried at room temperature for 25 minutes. The coating film was further dried at 125° C. for 20 minutes to form a charge-transporting layer. Thus, an electrophotographic photoreceptor was produced. This electrophotographic photoreceptor is referred to as photoreceptor P1.

Evaluation 2

The dielectric breakdown strength of this photoreceptor P1 was measured in the following manner. The photoreceptor was fixed in an environment having a temperature of 25° C. and a relative humidity of 50%. A charging roller which had a volume resistivity of about 2 MΩ·cm and was shorter than the drum length by about 2 cm at each end was pressed against the photoreceptor drum. A direct-current voltage of −3 kV was applied thereto and the time period required for the photoreceptor to suffer dielectric breakdown was measured. As a result, the period was found to be 22 minutes.

Furthermore, the photoreceptor was mounted in an apparatus for electrophotographic-property evaluation (manufactured by Mitsubishi Chemical Corp.) produced in accordance with Measurement Standards of The Society of Electrophotography of Japan (The Society of Electrophotography of Japan, ed., *Zoku Denshishashin Gijutsu No Kiso To Ōyō*, Corona Publishing Co., Ltd., published in 1996, pp. 404-405). This photoreceptor was charged so as to result in a surface potential of −700 V and then irradiated with 780 nm laser light at an intensity of 5.0 μJ/cm$^2$. At 100 msec after the exposure, the surface potential (VL) was measured in an environment having a temperature of 25° C. and a relative humidity of 50% (hereinafter often referred to as NN environment) and an environment having a temperature of 5° C. and a relative humidity of 10% (hereinafter often referred to as LL environment). The results obtained are shown in Table 2.

TABLE 2

| VL (NN) | VL (LL) |
|---|---|
| −75 V | −183 V |

The electrophotographic photoreceptor of the invention has even layers free from aggregates or the like, changes little in potential with changing environment, and has excellent dielectric breakdown resistance.

Example 6

As a coating fluid for undercoat layer formation, use was made of the coating fluid for undercoat layer formation A described in the Example given above. This coating fluid was applied to an aluminum pipe obtained through cutting having an outer diameter of 30 mm, length of 285 mm, and wall thickness of 0.8 mm by dip coating in an amount of 2.4 μm in terms of dry-film thickness. The coating fluid applied was dried to form an undercoat layer.

The coating fluid for charge-generating-layer formation SE3 was applied to the undercoat layer by dip coating in an amount of 0.4 μm in terms of dry-film thickness. The coating fluid applied was dried to form a charge-generating layer.

Subsequently, a coating fluid obtained by dissolving 60 parts of a composition (A), as a charge-transporting material, produced by the procedure described in the Example 1 of JP-A-2002-080432 and consisting mainly of the structure represented by the following Composition (A),

[Ka-12]

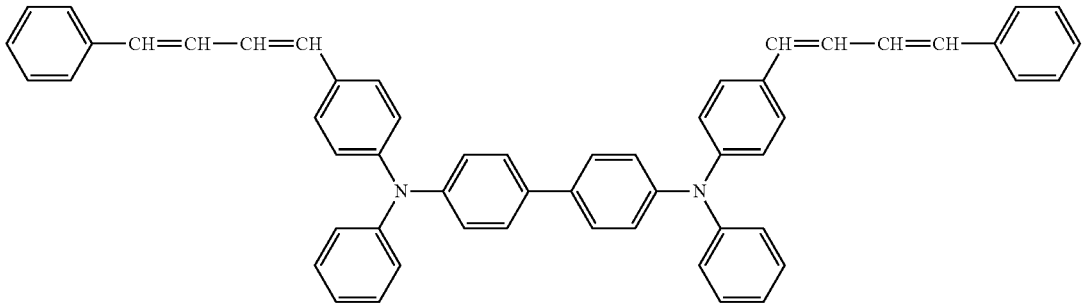

Composition (A)

100 parts of a polycarbonate resin having the repeating structures shown below,

[Ka-13]

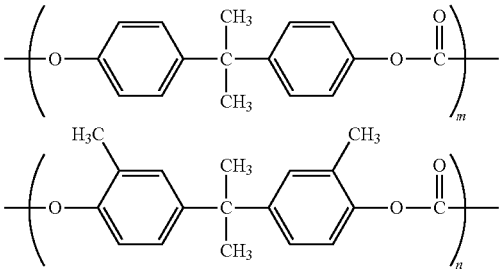

(m:n = 7:3)

and 0.05 parts by weight of a silicone oil in 640 parts by weight of a tetrahydrofuran/toluene (8/2) mixed solvent was applied to the charge-generating layer in an amount of 10 μm in terms of dry-film thickness. The coating fluid applied was dried to form a charge-transporting layer. Thus, an electrophotographic photoreceptor was produced.

The photoreceptor produced was mounted in a cartridge for a color printer (product name: InterColor LP-1500C) manufactured by Seiko Epson Corp., and a full-color image was formed. As a result, a satisfactory image could be obtained. The number of minute color spots observed in a 1.6-cm square in the image obtained was only 8.

The electrophotographic photoreceptor of the invention has satisfactory photoreceptor characteristics and high resistance to dielectric breakdown and is less apt to cause image defects such as color spots. Namely, it has highly excellent performances.

Example 7

The coating fluid for undercoat layer formation A was applied to an aluminum pipe obtained through cutting having an outer diameter of 24 mm, length of 236.5 mm, and wall thickness of 0.75 mm by dip coating in an amount of 2 μm in terms of dry-film thickness. The coating fluid applied was dried to form an undercoat layer. The coating fluid for photosensitive-layer formation SE7 was applied to the undercoat layer by dip coating in an amount of 0.6 μm in terms of dry-film thickness. The coating fluid applied was dried to form a charge-generating layer.

Subsequently, a coating fluid for charge-transporting-layer formation obtained by dissolving 67 parts of the triphenylamine compound shown below,

[Ka-14]

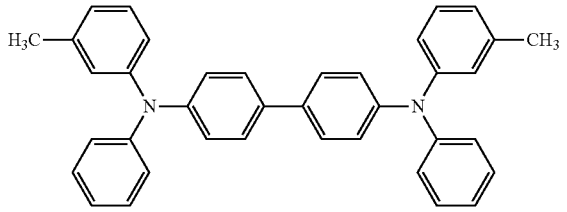

100 parts of a polycarbonate resin having the repeating structure shown below,

[Ka-15]

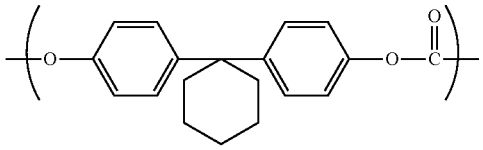

0.5 parts of the compound of the following structure,

[Ka-16]

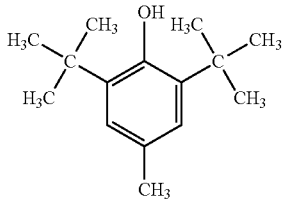

and 0.02 parts by weight of a silicone oil in 640 parts by weight of a tetrahydrofuran/toluene (8/2) mixed solvent was applied to the charge-generating layer in an amount of 25 μm in terms of dry-film thickness. The coating fluid applied was air-dried at room temperature for 25 minutes. The coating film was further dried at 125° C. for 20 minutes to form a charge-transporting layer. Thus, an electrophotographic photoreceptor was produced.

Evaluation 3

The electrophotographic photoreceptor obtained above was mounted in an apparatus for electrophotographic-property evaluation (manufactured by Mitsubishi Chemical Corp.) produced in accordance with Measurement Standards of The Society of Electrophotography of Japan (The Society of Electrophotography of Japan, ed., *Zoku Denshishashin Gijutsu No Kiso To Ōyō*, Corona Publishing Co., Ltd., published in 1996, pp. 404-405). The photoreceptor mounted was evaluated for electrical properties in cycling comprising charging, exposure, potential measurement, and erase in the following manner.

In the dark, a scorotron charging device was discharged at a grid voltage of −800 V to charge the photoreceptor and the initial surface potential of this photoreceptor was measured. Subsequently, 450-nm monochromatic light obtained by passing the light from a halogen lamp through an interference filter was caused to strike on the photoreceptor, and the irradiation energy (μJ/cm$^2$) which resulted in a surface potential of −350 V was measured; this value was taken as sensitivity $E_{1/2}$. As a result, the initial acceptance potential and the sensitivity $E_{1/2}$ were found to be −710 V and 3.3 μJ/cm$^2$, respectively.

Example 8

The coating fluid for undercoat layer formation A used in Example 5 was applied to a poly(ethylene terephthalate) sheet having a vapor-deposited aluminum coating on the surface with a wire-wound bar in an amount of 1.2 μm in terms of dry-film thickness. The coating fluid applied was dried to form an undercoat layer. Subsequently, 5 parts by weight of the D-form oxytitanium phthalocyanine used in Reference Example 1 (the Production Example 1 given in Japanese Patent Application No. 2004-291274) was subjected, together with 70 parts by weight of toluene, to a dispersing treatment with Ultra Apex Mill having a mill capacity of about 0.15 L (UAM), manufactured by Kotobuki Industries Co., Ltd., for 20 minutes using zirconia beads having a diameter of about 30 μm (trade name, YTZ; manufactured by Nikkato Corp.) as a dispersing medium under the conditions of a rotor peripheral speed of 8 m/sec and a liquid flow rate of 10 kg/hr while circulating a cooling liquid of 5-12° C. Subsequently, the resultant dispersion was subjected to a 150-minute US treatment. Thus, a dispersion SE8 was obtained. Furthermore, the same procedure as for the production of SE8 was conducted, except that in place of the D-form oxytitanium phthalocyanine, 8 parts by weight of the electron-transporting substance represented by the following structural formula (6) was used together with 112 parts by weight of toluene. Thus, a dispersion SE9 was obtained.

On the other hand, 60 parts by weight of the hole-transporting substance represented by the following structural formula (7) and 100 parts by weight of the polycarbonate resin used in Example 7 were dissolved in 420 parts by weight of toluene. Thereto was added 0.05 parts by weight of a silicone oil as a leveling agent. The two dispersions (SE8 and SE9) were mixed with this solution by means of a homogenizer until the mixture became homogeneous. The coating fluid thus prepared was applied to the undercoat layer in an amount of 25 μm in terms of dry-film thickness. Thus, a positive-electrification single-layer type sheet-form electrophotographic photoreceptor EX was obtained. In the coating fluid, the resin showed satisfactory solubility in the solvent. Even when the coating fluid was allowed to stand for 1 month after the preparation thereof, no abnormality, e.g., gelation, was observed.

[Ka-17]

(6)

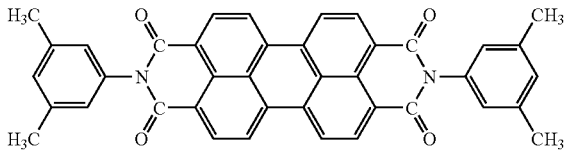

(Electron-transporting substance)

(7)

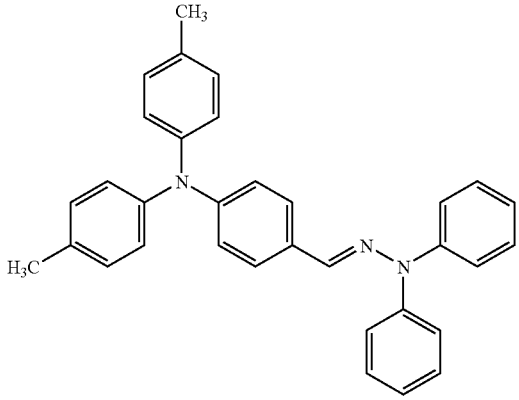

(Hole-transporting substance)

Evaluation 4

An apparatus for electrophotographic-property evaluation produced in accordance with Measurement Standards of The Society of Electrophotography of Japan (The Society of Electrophotography of Japan, ed., *Zoku Denshishashin Gijutsu No Kiso To Ōyō*, Corona Publishing Co., Ltd., pp. 404-405) was used. The photoreceptor EX was attached to an aluminum drum having a diameter of 80 mm to make the photoreceptor EX cylindrical, and the aluminum drum was electrically connected to the aluminum base in the photoreceptor EX. Thereafter, the drum was rotated at a constant rotation speed of 60 rpm and subjected to an electrical-property evaluation test in which the photoreceptor was evaluated through cycling comprising charging, exposure, potential measurement, and erase. In this test, the photoreceptor was charged to an initial surface potential of +700 V and then exposed at 1.5 μJ/cm$^2$ to 780-nm monochromatic light obtained by passing the light from a halogen lamp through an interference filter. The surface potential after the exposure (hereinafter often referred to as VL+) was measured. In the VL measurement, the time period from the exposure to the potential measurement was 100 ms. The measurement was made in an environment having a temperature of 25° C. and a relative humidity of 50%. The results obtained are shown in Table 3.

Comparative Example 9

A positive-electrification single-layer type electrophotographic photoreceptor PX was obtained in the same manner as in Example 8, except that a 20-minute dispersing treatment with a sand grinding mill (SGM) (dispersing medium: trade name, GB200M; manufactured by Potters-Ballotini Co., Ltd.) in place of the UAM used in Example 8 was conducted to obtain a dispersion containing D-form oxytitanium phthalocyanine and a dispersion containing the hole-transporting substance represented by structural formula (7) given above. In the resultant coating fluid, the resin showed satisfactory solubility in the solvent. However, at the time when one month had passed since the coating fluid preparation, it was observed that the solution had gelled. Electrical properties were examined in the same manner as in Example 8. The results obtained are shown in Table 3.

TABLE 3

| | VL+ |
|---|---|
| EXAMPLE 8 | 78 V |
| COMPARATIVE EXAMPLE 9 | 82 V |

While the invention has been described in detail and with reference to specific embodiments thereof, it will be apparent to one skilled in the art that various changes and modifications can be made therein without departing from the spirit and scope thereof.

This application is based on a Japanese patent application filed on May 18, 2006 (Application No. 2006-138650), the contents thereof being herein incorporated by reference.

Industrial Applicability

The coating fluid for photosensitive-layer formation of the invention has high storage stability, and enables an electrophotographic photoreceptor having a charge-generating layer formed by applying the coating fluid to be highly efficiently produced so as to have high quality. This electrophotographic photoreceptor has excellent long-lasting stability and is less apt to cause image defects, etc. Because of this, the image-forming apparatus employing this photoreceptor can form images of high quality. Furthermore, according to the process for producing a coating fluid for photosensitive-layer formation, not only the coating fluid can be efficiently produced and can have higher storage stability but also an electrophotographic photoreceptor having higher quality can be obtained. The invention can hence be advantageously used in various fields where an electrophotographic photoreceptor is used, such as, e.g., the fields of copiers, printers, and printing machines.

The invention claimed is:

1. An electrophotographic photoreceptor, comprising:

(i) a charge-generating material comprising a metal coordination phthalocyanine;

(ii) a binder resin; and (iii) a photosensitive layer formed from a coating fluid comprising the charge-generating material (i), wherein a dispersing medium comprising particles having an average particle diameter in a range of from 10 μm to 100 μm, disperses the charge-generating material (i) in the coating fluid, wherein the metal coordination phthalocyanine comprises a phthalocyanine pigment and the phthalocyanine pigment in the coating fluid comprises primary particles and secondary aggregated particles, which have a 50% cumulative particle diameter (D50) of 0.13 μm or smaller and a 90% cumulative particle diameter (D90) of 0.25 μm or smaller, as determined by a dynamic light scattering method, wherein particles of the metal coordination phthalocyanine in the coating fluid have a dispersion index of about 1.41 to at most 2.51.

2. The photoreceptor of claim 1, wherein the particles comprise zirconia beads.

3. The photoreceptor of claim 1, wherein the dispersion is obtained with a ball mill.

4. The photoreceptor of claim 3, wherein the ball mill is a wet stirring ball mill comprising:

(i) a cylindrical stator;

(ii) a slurry feed opening formed in one end of the stator;

(iii) a slurry discharge opening formed in another end of the stator;

(iv) a rotor for stirring mixing the dispersing medium to be packed in the stator and a slurry which is to be fed through the slurry feed opening and comprises the charge-generating material and the binder resin; and (v) a separator connected to the slurry discharge opening and capable of separating the slurry from the dispersing medium by an action of centrifugal force and discharging the separated slurry through the slurry discharge opening, wherein the separator is rotated driven with a shaft, and an axial center of the shaft has a hollow discharge passage connected to the slurry discharge opening.

5. The photoreceptor of claim 3, wherein the ball mill is a wet stirring ball mill comprising:

(i) a cylindrical stator;

(ii) a slurry feed opening formed in one end of the stator;

(iii) a slurry discharge opening formed in another end of the stator;

(iv) a rotor for stirring mixing the dispersing medium to be packed in the stator and a slurry which is to be fed through the slurry feed opening and comprises the charge-generating material and the binder resin; and (v) a separator connected to the slurry discharge opening and capable of separating the slurry from the dispersing medium by an action of centrifugal force and discharging the separated slurry through the slurry discharge opening, wherein the separator comprises (v-a) two disks, each of which has a blade-fitting groove on the opposed inner side thereof;

(v-b) a blade interposed between the disks and fitted in the fitting grooves; and (v-c) a supporter which holds from both sides the disks having the blades interposed therebetween.

6. The photoreceptor of claim 1, wherein the photosensitive layer is a single-layer photosensitive layer formed from a coating fluid obtained by further incorporating a charge-transporting material into the coating fluid.

7. The photoreceptor of claim 1, wherein the photosensitive layer is a lamination photosensitive layer wherein (a) a charge-generating layer formed from the coating fluid and (b) a charge-transporting layer formed from a second coating fluid comprising a charge-transporting material, are laminated.

8. An image-forming apparatus, comprising:

the photoreceptor of claim 1;

a charging device which charges the photoreceptor;

an imagewise-exposure device which imagewise exposes the charged photoreceptor to a light to form an electrostatic latent image;

a development device which develops the electrostatic latent image with a toner; and a transfer device which transfers the toner to an object to be transferred.

9. The apparatus of claim 8, wherein the charging device is in contact with the electrophotographic photoreceptor at least when the electrophotographic photoreceptor is charged or when the latent image formed on the electrophotographic photoreceptor is developed.

10. The apparatus of claim 8, wherein the light employed in the imagewise-exposure device has a wavelength in the range of from 350 nm to 600 nm.

11. An electrophotographic photoreceptor cartridge, comprising:

the photoreceptor of claim 1; and at least one of a charging device which charges the photoreceptor, an exposure device which imagewise exposes the charged photoreceptor to a light to form an electrostatic latent image, a development device which develops the electrostatic latent image formed on the photoreceptor, a transfer device which transfers the toner to an object to be transferred, and a cleaning device which recovers the toner adherent to the photoreceptor.

12. The cartridge of claim 11, wherein the charging device is in contact with the photoreceptor at least when the photoreceptor is charged or when the latent image formed on the photoreceptor is developed.

13. The photoreceptor of claim 1, wherein particles of the metal coordination phthalocyanine in the coating fluid have a dispersion index of about 1.41 to at most 1.70.

14. An electrophotographic photoreceptor, comprising:

a photosensitive layer formed from a coating fluid, wherein the coating fluid is suitable for forming a photosensitive layer of an electrophotographic photoreceptor, and wherein the coating fluid comprises (a) a charge-generating material and (b) a binder resin, wherein the charge-generating material is a phthalocyanine pigment and the phthalocyanine pigment in the coating fluid comprises primary particles and secondary aggregated particles, which have a 50% cumulative particle diameter (D50) of 0.13 μm or smaller and have a 90% cumulative particle diameter (D90) of 0.25 μm or smaller, as determined by a dynamic light scattering method, wherein particles of the phthalocyanine pigment in the coating fluid have a dispersion index of about 1.41 to at most 2.51.

15. The photoreceptor of claim 14, wherein the photosensitive layer is a single-layer photosensitive layer formed from a coating fluid obtained by further incorporating a charge-transporting material into the coating fluid for photosensitive-layer formation containing a charge-generating material.

16. The photoreceptor of claim 14, wherein the photosensitive layer is a lamination photosensitive layer wherein (a) a charge-generating layer formed from the coating fluid and (b) a charge-transporting layer formed from a second coating fluid comprising a charge-transporting material, are laminated.

* * * * *